US011131961B2

(12) United States Patent
Maeta et al.

(10) Patent No.: US 11,131,961 B2
(45) Date of Patent: Sep. 28, 2021

(54) IMAGE-FORMING APPARATUS THAT PREVENTS ATTACHMENT OF TONER CARTRIDGE TO DRAWER WITHOUT MOUNTING OF PROCESS CARTRIDGE ON THE DRAWER

(71) Applicant: Brother Kogyo Kabushiki Kaisha, Nagoya (JP)

(72) Inventors: Daisuke Maeta, Nagoya (JP); Shougo Sato, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/950,146

(22) Filed: Nov. 17, 2020

(65) Prior Publication Data

US 2021/0191310 A1 Jun. 24, 2021

(30) Foreign Application Priority Data

Dec. 24, 2019 (JP) ..... JP2019-232606

(51) Int. Cl.
*G03G 21/18* (2006.01)
*G03G 15/08* (2006.01)

(52) U.S. Cl.
CPC ..... *G03G 21/1842* (2013.01); *G03G 15/0881* (2013.01); *G03G 21/1814* (2013.01); *G03G 2221/1884* (2013.01); *G03G 2221/1892* (2013.01)

(58) Field of Classification Search
CPC ..... G03G 21/1842; G03G 15/0881; G03G 21/1814; G03G 2221/1884; G03G 2221/1892
See application file for complete search history.

(56) References Cited

U.S. PATENT DOCUMENTS 8,588,648 B2 * 11/2013 Itabashi ..... G03G 21/1623 399/114
2005/0265736 A1 12/2005 Seto et al.
2011/0033201 A1 2/2011 Akutsu et al.
(Continued)

FOREIGN PATENT DOCUMENTS

JP 2010-164991 A 7/2010
JP 2011-053656 A 3/2011
(Continued)

*Primary Examiner* — Sandra Brase
(74) *Attorney, Agent, or Firm* — Burr & Brown, PLLC

(57) ABSTRACT

An image-forming apparatus includes: a main casing; a drawer movable in a first direction relative to the main casing; a process cartridge detachably mountable on the drawer; and a toner cartridge. The drawer includes a first drawer side plate and a second drawer side plate spaced apart from each other in a second direction crossing the first direction. The process cartridge includes: a photosensitive drum rotatable about an axis extending in the second direction when the process cartridge is mounted on the drawer; and a developing device for supplying toner to the photosensitive drum. When the process cartridge is mounted on the drawer and the toner cartridge is attached to the process cartridge, the toner cartridge has a length in the second direction greater than a distance in the second direction between the first drawer side plate and the second drawer side plate.

15 Claims, 16 Drawing Sheets

(56) References Cited

U.S. PATENT DOCUMENTS

| | | | | |
|---|---|---|---|---|
| 2011/0182612 | A1* | 7/2011 | Kamimura ..... | G03G 21/1676 399/110 |
| 2011/0182613 | A1* | 7/2011 | Kamimura ..... | G03G 15/0178 399/110 |
| 2011/0217068 | A1 | 9/2011 | Kamimura et al. | |
| 2015/0362888 | A1 | 12/2015 | Itabashi | |

FOREIGN PATENT DOCUMENTS

| | | | |
|---|---|---|---|
| JP | 2011-186067 | A | 9/2011 |
| JP | 2016-004115 | A | 1/2016 |

* cited by examiner

IMAGE-FORMING APPARATUS THAT PREVENTS ATTACHMENT OF TONER CARTRIDGE TO DRAWER WITHOUT MOUNTING OF PROCESS CARTRIDGE ON THE DRAWER

CROSS REFERENCE TO RELATED APPLICATION

This application claims priority from Japanese Patent Application No. 2019-232606 filed Dec. 24, 2019. The entire content of the priority application is incorporated herein by reference.

TECHNICAL FIELD

The present disclosure relates to an image-forming apparatus.

BACKGROUND

Conventionally, an image-forming apparatus includes a main casing, a drawer, a process cartridge, and a toner cartridge. The drawer is movable between an inner position and an outer position. The drawer is positioned inside the main casing when the drawer is at the inner position. The drawer is positioned outside the main casing when the drawer is at the outer position. The process cartridge includes a photosensitive drum and a developing device. The developing device can supply toner to the photosensitive drum. The process cartridge is attachable to and detachable from the drawer. The toner cartridge stores toner therein. The toner cartridge is attachable to and detachable from the process cartridge (for example, refer to Japanese Patent Application Publication No. 2011-186067).

SUMMARY

In the above described in image-forming apparatus, a user may happen to mount the toner cartridge onto the drawer in a state where the process cartridge is removed from the drawer.

In view of the foregoing, it is an object of the disclosure to provide an image-forming apparatus that can prevent a user from attaching a toner cartridge to a drawer in a state where a process cartridge is removed from the drawer.

In order to attain the above and other objects, according to one aspect, the disclosure provides an image-forming apparatus including a main casing, a drawer, a process cartridge, and a toner cartridge. The drawer is movable in a first direction between an inner position and an outer position relative to the main casing. The drawer is accommodated in the main casing at the inner position, and at least a part of the drawer is positioned outside the main casing at the outer position. The drawer includes a first drawer side plate and a second drawer side plate spaced apart from each other in a second direction crossing the first direction. The process cartridge is detachably mountable on the drawer. The process cartridge includes: a photosensitive drum rotatable about a druin axis, the drum axis extending in the second direction when the process cartridge is mounted on the drawer; and a developing device configured to supply toner to the photosensitive drum. The toner cartridge is configured to store the toner. When the process cartridge is mounted on the drawer and the toner cartridge is attached to the process cartridge, the toner cartridge has a length in the second direction that is greater than a distance in the second direction between the first drawer side plate and the second drawer side plate.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, an image-forming apparatus 1 according to one embodiment of the present disclosure will be described with reference to the accompanying drawings.

1. Overview of Image-Forming Apparatus 1

First, an overall structure of the image-forming apparatus 1 will be described with reference to FIGS. 1 to 3.

Figure 1:
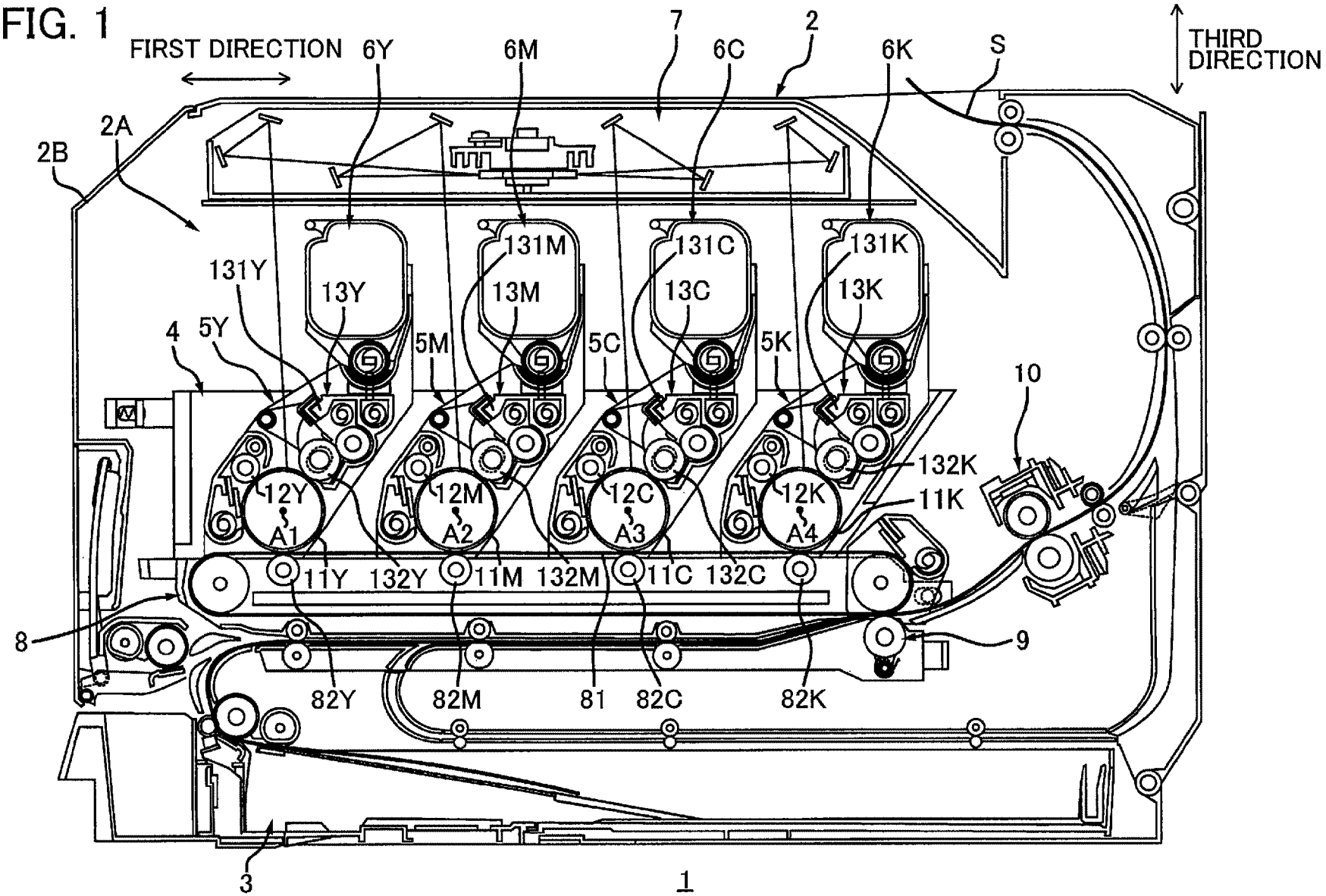
FIG. 1 is a vertical cross-sectional view schematically illustrating an overall configuration of an image-forming apparatus according to one embodiment.

As illustrated in FIG. 1, the image-forming apparatus 1 includes a main casing 2, a sheet cassette 3, a drawer 4, four process cartridges 5Y, 5M, 5C and 5K, four toner cartridges 6Y, 6M, 6C and 6K, an exposure device 7, a belt unit 8, a transfer roller 9, and a fixing device 10.

The main casing 2 is configured to accommodate the sheet cassette 3, the drawer 4, the four process cartridges 5Y, 5M, 5C, and 5K, the four toner cartridges 6Y, 6M, 6C, and 6K, the exposure device 7, the belt unit 8, the transfer roller 9, and the fixing device 10.

Figure 2:
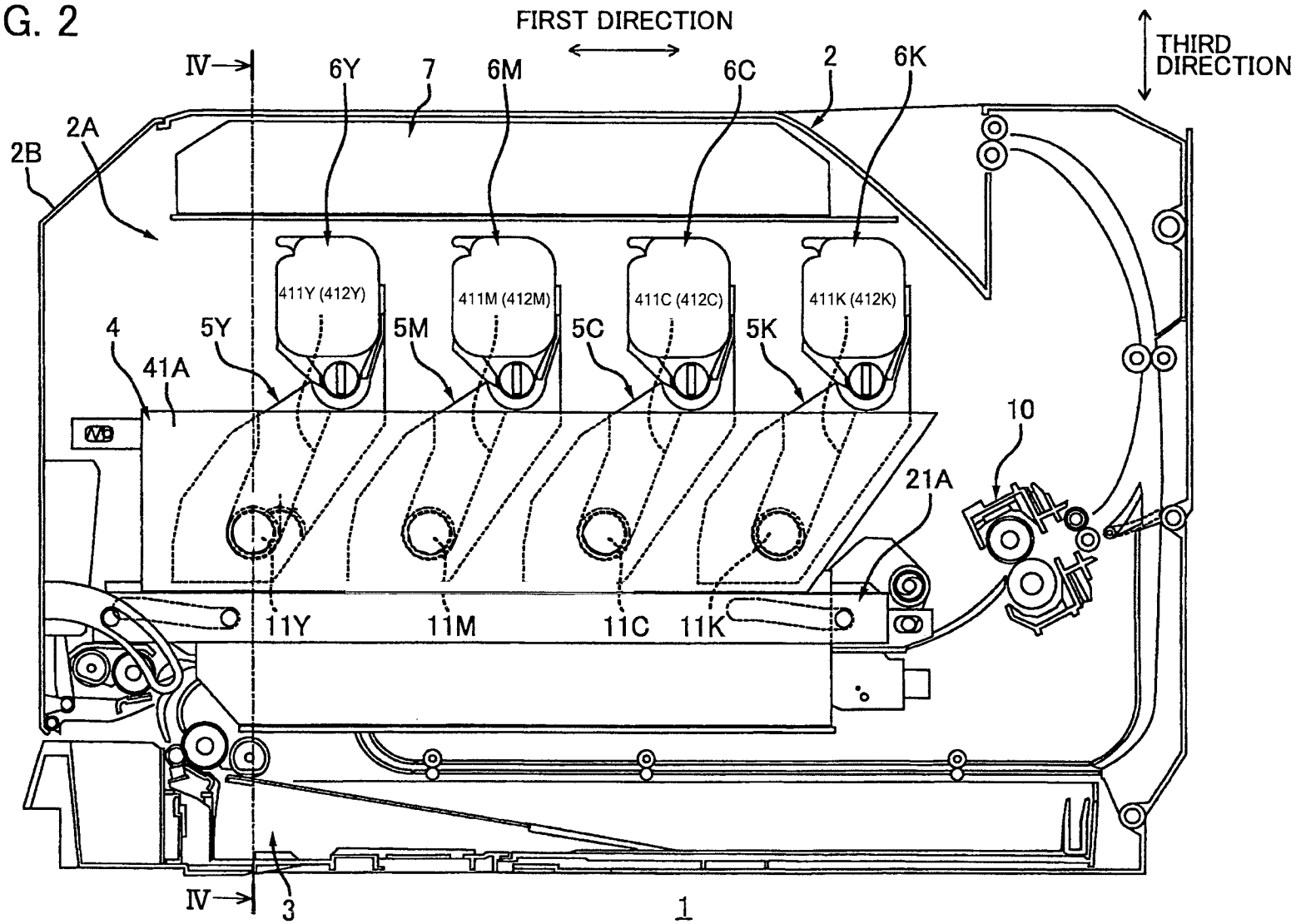
FIG. 2 is an explanatory view illustrating movement of a drawer relative to a main casing of the image-forming apparatus according to one embodiment, wherein the drawer is at an inner position and a cover of the main casing is at a closed position.
Figure 3:
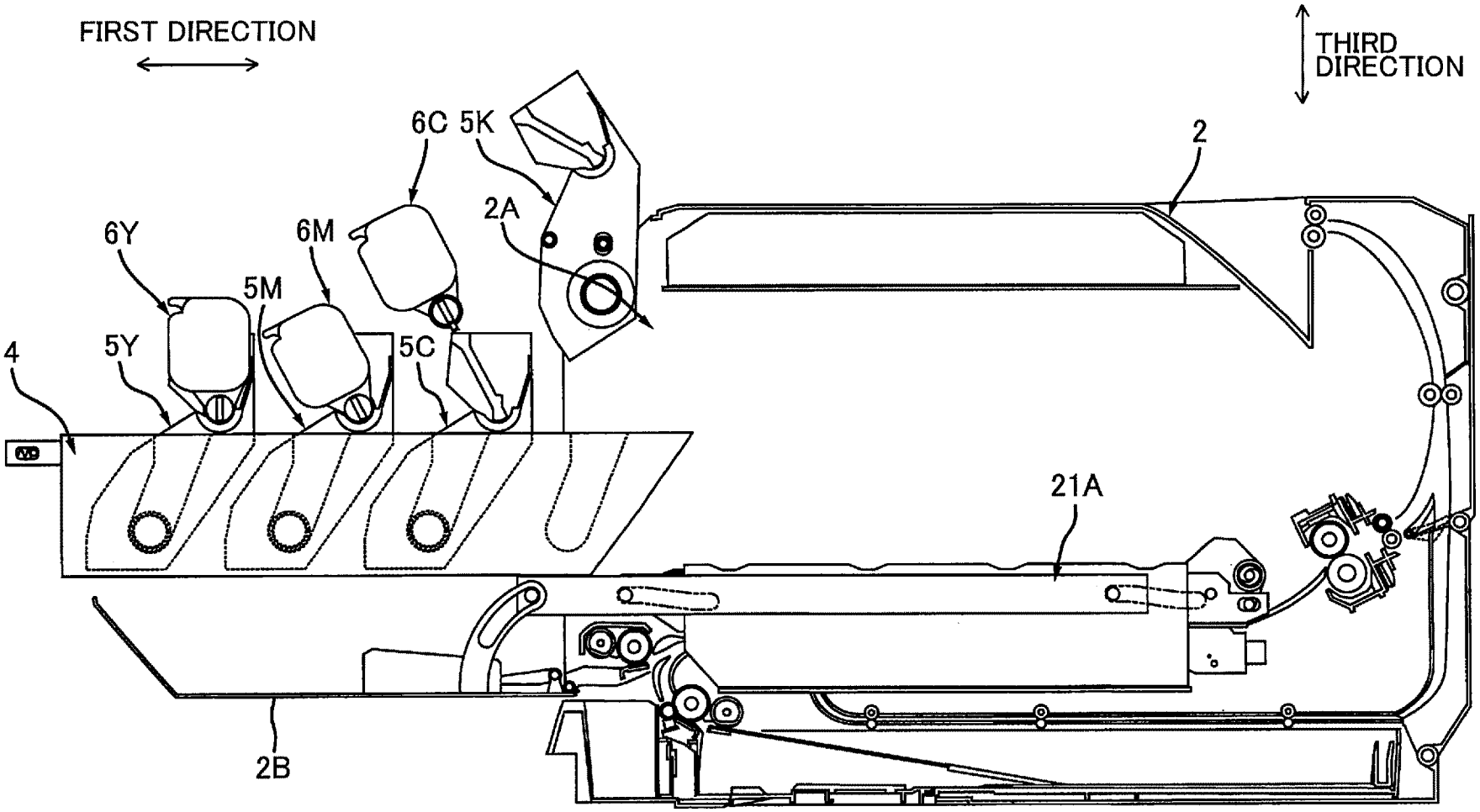
FIG. 3 is an explanatory view illustrating movement of the drawer relative to the main casing in the image-forming apparatus according to one embodiment, wherein the drawer is at an outer position and the cover of the main casing is at an open position.

The drawer 4 is movable relative to the main casing 2, as illustrated in FIGS. 1 to 3. Hereinafter, a direction in which the drawer 4 is movable relative to the main casing 2 will be referred to as a first direction.

As illustrated in FIGS. 2 and 3, the main casing 2 has an opening 2A. The main casing 2 includes a cover 2B.

The opening 2A is formed at one end portion of the main casing 2 in the first direction.

The cover 2B is movable between a closed position (see FIG. 2) and an open position (see FIG. 3). The cover 2B covers the opening 2A when the cover 2B is at the closed position. The cover 2B exposes the opening 2A when the cover 2B is at the open position.

As illustrated in FIG. 1, the sheet cassette 3 is configured to accommodate sheets of paper S. Each sheet S in the sheet cassette 3 is configured to be conveyed toward the transfer roller 9.

As illustrated in FIGS. 2 and 3, the drawer 4 is movable in the first direction between an inner position (FIG. 2) and an outer position (FIG. 3) via the opening 2A while the cover 2B is at the open position. As illustrated in FIG. 2, the drawer 4 as a whole is positioned inside the main casing 2 when the drawer 4 is at the inner position. As illustrated in FIG. 3, at least a portion of the drawer 4 is positioned outside the main casing 2 when the drawer 4 is at the outer position.

The respective process cartridges 5Y, 5M, 5C, and 5K are attachable to and detachable from the drawer 4. Specifically, each of the process cartridges 5Y, 5M, 5C, and 5K mounted on the drawer 4 can be removed from the drawer 4. When being mounted on the drawer 4, the process cartridges 5Y, 5M, 5C, and 5K are arrayed in the first direction, as illustrated in FIGS. 1 and 2.

Specifically, each of the process cartridges 5Y, 5M, 5C, and 5K can be mounted on the drawer 4 in a state where the drawer 4 is at the outer position. Each of the process cartridges 5Y, 5M, 5C, and 5K mounted on the drawer 4 can be detached from the drawer 4 while the drawer 4 is at the outer position.

The process cartridges 5Y, 5M, 5C, and 5K respectively have the same structures as one another.

Specifically, as illustrated in FIG. 1, the process cartridge 5Y includes a photosensitive drum 11Y, a charging device 12Y, and a developing device 13Y.

The photosensitive drum 11Y extends in a second direction crossing the first direction in a state where the process cartridge 5Y is mounted on the drawer 4. The photosensitive drum 11Y has a cylindrical shape. The photosensitive drum 11Y is rotatable about a first axis A1 extending in the second direction in the state where the process cartridge 5Y is mounted on the drawer 4.

The charging device 12Y is configured to charge a peripheral surface of the photosensitive drum 11Y. In the present embodiment, the charging device 12Y is a charging roller, but the charging device 12Y may be a scorotron charger.

The developing device 13Y is configured to supply toner to the photosensitive drum 11Y. Specifically, the developing device 13Y includes a developing casing 131Y and a developing roller 132Y.

The developing casing 131Y is configured to store toner that is supplied from the toner cartridge 6Y. The developing casing 131Y has an opening 133 (see FIG. 8). Toner supplied from the toner cartridge 6Y flows into the developing casing 131Y via the opening 133. The developing casings 131M, 131C and 131K have the same structure as the developing casing 131Y.

The developing roller 132Y is configured to supply the toner in the developing casing 131Y to the photosensitive drum 11Y. The developing roller 132Y is in contact with the photosensitive drum 11Y. Incidentally, the developing roller 132Y may be configured to be separated from the photosensitive drum 11Y. The developing rollers 132M, 132C and 132K have the same structure as the developing roller 132Y.

The process cartridge 5M includes a photosensitive drum 11M, a charging device 12M, and a developing device 13M. The photosensitive drum 11M is rotatable about a second axis A2. The second axis A2 extends in the second direction in a state where the process cartridge 5M is mounted on the drawer 4. The charging device 12M is configured to charge a peripheral surface of the photosensitive drum 11M. The developing device 13M is configured to supply toner to the photosensitive drum 11M (see FIG. 1).

The process cartridge 5C includes a photosensitive drum 11C, a charging device 12C, and a developing device 13C. The photosensitive drum 11C is rotatable about a third axis A3. The third axis A3 extends in the second direction in a state where the process cartridge 5C is mounted on the drawer 4. The charging device 12C is configured to charge a peripheral surface of the photosensitive drum 11C. The developing device 13C is configured to supply toner to the photosensitive drum 11C (see FIG. 1).

The process cartridge 5K includes a photosensitive drum 11K, a charging device 12K, and a developing device 13K. The photosensitive drum 11K is rotatable about a fourth axis A4. The fourth axis A4 extends in the second direction in a state where the process cartridge 5K is mounted on the drawer 4. The charging device 12K is configured to charge a peripheral surface of the photosensitive drum 11K. The developing device 13K is configured to supply toner to the photosensitive drum 11K.

Each of the toner cartridges 6Y, 6M, 6C, and 6K stores toner of a different color.

As illustrated in FIG. 3, the toner cartridge 6Y is attachable to and detachable to the process cartridge 5Y in a state where the process cartridge 5Y is mounted on the drawer 4. Specifically, the toner cartridge 6Y can be attached to the process cartridge 5Y in a state where the process cartridge 5Y is kept being mounted on the drawer 4. Further, the toner cartridge 6Y attached to the process cartridge 5Y can be removed from the process cartridge 5Y in the state where the process cartridge 5Y is kept being mounted on the drawer 4. The toner cartridge 6Y can supply toner to the developing device 13Y (see FIG. 1) in a state where the toner cartridge 6Y is attached to the process cartridge 5Y.

The toner cartridge 6M is attachable to and detachable to the process cartridge 5M in a state where the process cartridge 5M is mounted on the drawer 4. Specifically, the toner cartridge 6M can be attached to the process cartridge 5M in a state where the process cartridge 5M is kept being mounted on the drawer 4. Further, the toner cartridge 6M attached to the process cartridge 5M can be removed from the process cartridge 5M in the state where the process cartridge 5M is kept being mounted on the drawer 4. The toner cartridge 6M can supply toner to the developing device 13M (see FIG. 1) in a state where the toner cartridge 6M is attached to the process cartridge 5M.

Likewise, the toner cartridge 6C is attachable to and detachable to the process cartridge 5C in a state where the process cartridge 5C is mounted on the drawer 4. Specifically, the toner cartridge 6C can be attached to the process cartridge 5C in a state where the process cartridge 5C is kept being mounted on the drawer 4. Further, the toner cartridge 6C attached to the process cartridge 5C can be removed from the process cartridge 5C in the state where the process cartridge 5C is kept being mounted on the drawer 4. The toner cartridge 6C can supply toner to the developing device 13C (see FIG. 1) in a state where the toner cartridge 6C is attached to the process cartridge 5C.

Similarly, the toner cartridge 6K is attachable to and detachable to the process cartridge 5K in a state where the process cartridge 5K is mounted on the drawer 4. Specifically, the toner cartridge 6K can be attached to the process cartridge 5K in a state where the process cartridge 5K is kept being mounted on the drawer 4. Further, the toner cartridge 6K attached to the process cartridge 5K can be removed from the process cartridge 5K in the state where the process cartridge 5K is kept being mounted on the drawer 4. The toner cartridge 6K can supply toner to the developing device 13K (see FIG. 1) in a state where the toner cartridge 6K is attached to the process cartridge 5K.

As illustrated in FIG. 1, the exposure device 7 is configured to expose peripheral surfaces of the respective photosensitive drums 11Y, 11M, 11C, and 11K to light in a state where the drawer 4 is at the inner position with the process cartridges 5Y, 5M, 5C, and 5K mounted on the drawer 4. In the present embodiment, the exposure device 7 is a laser scanning unit.

The belt unit 8 is positioned below the process cartridges 5Y, 5M, 5C, and 5K in the state where the process cartridges 5Y, 5M, 5C, and 5K are mounted on the drawer 4 and the drawer 4 is at the inner position. The belt unit 8 includes an intermediate transfer belt 81 and transfer rollers 82Y, 82M, 82C, and 82K. That is, the image-forming apparatus 1 includes the intermediate transfer belt 81.

The intermediate transfer belt 81 is in contact with each of the photosensitive drums 11Y, 11M, 11C, and 11K in the state where the process cartridges 5Y, 5M, 5C, and 5K are mounted on the drawer 4 and the drawer 4 is at the inner position.

The transfer roller 82Y is configured to transfer toner on the photosensitive drum 11Y onto the intermediate transfer belt 81. The transfer roller 82M is configured to transfer toner on the photosensitive drum 11Y onto the intermediate transfer belt 81. The transfer roller 82C is configured to transfer toner on the photosensitive drum 11C onto the intermediate transfer belt 81. The transfer roller 82K is configured to transfer toner on the photosensitive drum 11K onto the intermediate transfer belt 81. In other words, the toner on the photosensitive drum 11Y, the toner on the photosensitive drum 11Y, the toner on the photosensitive drum 11C, and the toner on the photosensitive drum 11K are respectively configured to be transferred onto the intermediate transfer belt 81.

The transfer roller 9 is configured to transfer the toner on the intermediate transfer belt 81 onto a sheet S. Specifically, a sheet S conveyed from the sheet cassette 3 toward the transfer roller 9 is conveyed to the fixing device 10 after passing through a position between the transfer roller 9 and the intermediate transfer belt 81. The transfer roller 9 transfers the toner on the intermediate transfer belt 81 onto the sheet S while the sheet S passes the position between the transfer roller 9 and the intermediate transfer belt 81.

The fixing device 10 is configured to apply heat and pressure to the sheet S, so that the toner that has been transferred on the sheet S is thermally fixed to the sheet S. After passing through the fixing device 10, the sheet S is discharged onto an upper surface of a top wall of the main casing 2.

2. Details of the Drawer 4

Now, the drawer 4 will be described in detail with reference to FIGS. 2 and 4.

Figure 4:
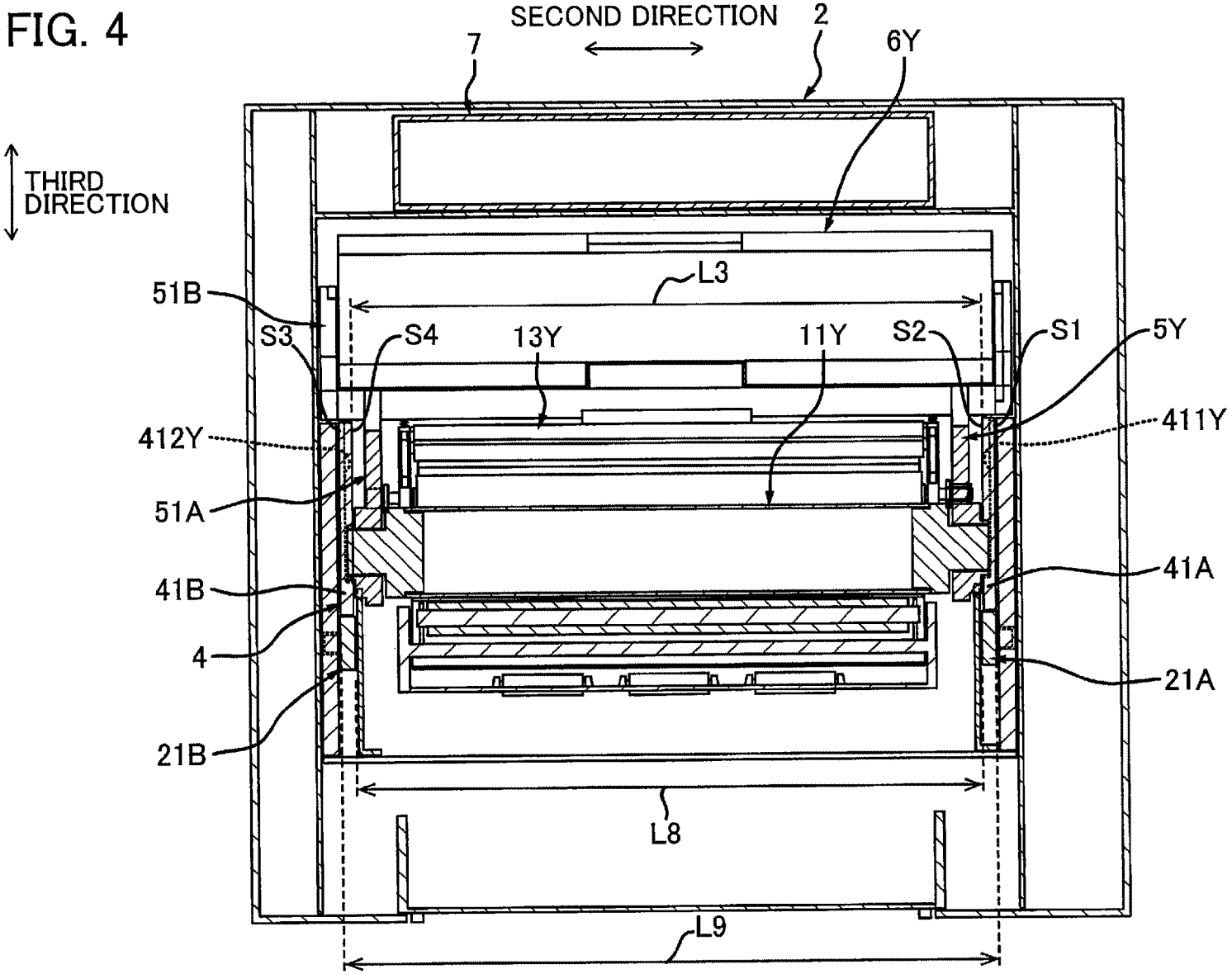
FIG. 4 is a cross-sectional view of the image-forming apparatus according to one embodiment taken along a plane IV-IV in FIG. 2.
Figure 5:
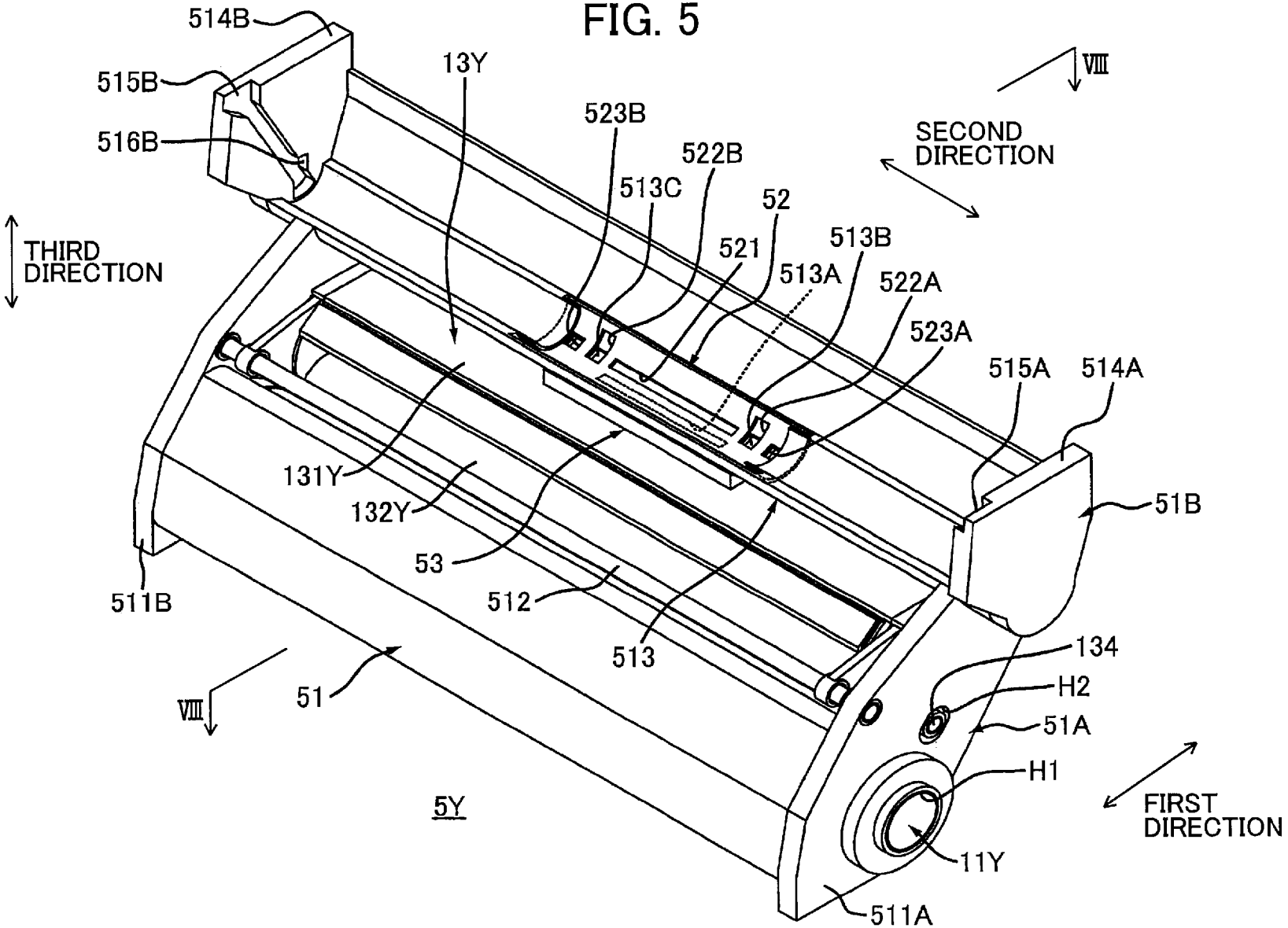
FIG. 5 is a perspective view of a process cartridge according to the embodiment, wherein a shutter of the process cartridge is at a closed position.

As illustrated in FIGS. 4 and 5, the drawer 4 is open in a third direction crossing both the first direction and the second direction. Preferably, the third direction is orthogonal to both the first direction and the second direction. In the present embodiment, the third direction coincides with an up-down direction (vertical direction).

The drawer 4 includes a drawer side plate 41A and a drawer side plate 41B.

The drawer side plate 41A is positioned at one end portion of the drawer 4 in the second direction. Referring to FIG. 4, the drawer side plate 41A extends in the third direction. The drawer side plate 41A has a surface S1 and a surface S2 opposite each other in the second direction. The surface S2 is positioned between the surface S1 and the drawer side plate 41B in the second direction. That is, the surface S2 is positioned closer to the drawer side plate 41B than the surfaced S1 is to the drawer side plate 41B in the second direction. As illustrated in FIG. 2, the drawer side plate 41A includes four drum guides 411Y, 411M, 411C, and 411K.

The drum guides 411Y, 411M, 411C, and 411K are formed on the surface S2. The drum guides 411Y, 411M, 411C, and 411K are arrayed in the first direction to be spaced apart from one another. Each of the drum guides 411Y, 411M, 411C, and 411K extends generally in the third direction.

As illustrated in FIGS. 2 and 4, the drum guide 411Y is configured to guide one end portion of the photosensitive drum 11Y in the second direction while the process cartridge 5Y is mounted on the drawer 4. The drum guide 411M is configured to guide one end portion of the photosensitive drum 11M in the second direction while the process cartridge 5M is mounted ono the drawer 4. The drum guide 411C is configured to guide one end portion of the photosensitive drum 11C in the second direction while the process cartridge 5C is mounted on the drawer 4. The drum guide 411K is configured to guide one end portion of the photosensitive drum 11K in the second direction while the process cartridge 5K is mounted on the drawer 4.

As illustrated in FIG. 4, the drawer side plate 41B is positioned at another end portion of the drawer 4 in the second direction. The drawer side plate 41B is spaced away from the drawer side plate 41A in the second direction.

The drawer side plate 41B has a structure the same as that of the drawer side plate 41A in a symmetrical manner.

Specifically, the drawer side plate 41B extends in the third direction. The drawer side plate 41B has a surface S3 and a surface S4 opposite each other in the second direction. The surface S4 is positioned between the surface S3 and the drawer side plate 41A in the second direction. That is, the surface S4 is positioned closer to the drawer side plate 41A than the surface S3 is to the drawer side plate 41A in the second direction. The drawer side plate 41B includes four drum guides 412Y, 412M, 412C, and 412K, although the drum guides 412M, 412C, and 412K are not illustrated in the drawings. The drum guides 412Y, 412M, 412C, and 412K are formed on the surface S4. The drum guides 412Y, 412M, 412C, and 412K are arrayed in the first direction to be spaced apart from one another. Each of the drum guides 412Y, 412M, 412C, and 412K extends generally in the third direction.

The drum guide 412Y is configured to guide another end portion of the photosensitive drum 11Y in the second direction while the process cartridge 5Y is mounted on the drawer 4. The drum guide 412M is configured to guide another end portion of the photosensitive drum 11M in the second direction while the process cartridge 5M is mounted on the drawer 4. The drum guide 412C is configured to guide another end portion of the photosensitive drum 11C in the second direction while the process cartridge 5C is mounted on the drawer 4. The drum guide 412K is configured to guide another end portion of the photosensitive drum 11K in the second direction while the process cartridge 5K is mounted on the drawer 4.

3. Details of the Main Casing 2

Next, the main casing 2 will be described in detail with reference to FIGS. 2 through 4.

The main casing 2 includes a drawer guide 21A and a drawer guide 21B, as illustrated in FIG. 4.

In a state where the drawer 4 is at the inner position, the drawer guide 21A is positioned below the drawer side plate 41A.

The drawer guide 21A is configured to guide the drawer side plate 41A while the drawer 4 moves between the inner position and the outer position, as illustrated in FIGS. 2 and 3. Specifically, the drawer guide 21A has a flat plate-like shape and extends in the first direction. The drawer guide 21A is configured to make contact with a lower end portion of the drawer side plate 41A. The drawer side plate 41A is configured to slide on the drawer guide 21A in accordance with the movement of the drawer 4 between the inner position and the outer position.

The drawer guide 21B is spaced apart from the drawer guide 21A in the second direction. The drawer guide 21B is positioned below the drawer side plate 41B when the drawer 4 is at the inner position. The drawer guide 21B has the same structure as the drawer guide 21A. The drawer guide 21B is configured to make contact with a lower end portion of the drawer side plate 41B. The drawer side plate 41B is configured to slide on the drawer guide 21B in accordance with the movement of the drawer 4 between the inner position and the outer position.

4. Details of the Process Cartridge 5Y

Now, the process cartridge 5Y will be described in detail with reference to FIGS. 5 to 9. Details of the process cartridges 5M, 5C, and 5K will not be described hereinafter for simplification, since each of these process cartridges 5M, 5C, and 5K has the same structure as the process cartridge 5Y.

In the following description, the "first direction," "second direction," "third direction" and "fourth direction" with respect to the process cartridge 5Y will be referred to based on an assumption that the process cartridge 5Y is mounted on the drawer 4. Hence, the "first direction," "second direction," "third direction" and "fourth direction" with respect to the process cartridge 5Y are coincident with the "first direction," "second direction," "third direction" and "fourth direction" with respect to the image-forming apparatus 1 and drawer 4.

As illustrated in FIG. 5, the process cartridge 5Y includes a process frame 51, a shutter 52, and a sealing member 53, in addition to the above-described photosensitive drum 11Y, the charging device 12Y, and the developing device 13Y.

The process frame 51 extends in the second direction. The process frame 51 includes a first support portion 51A and a second support portion 51B. In other words, the process cartridge 5Y includes the first support portion 51A and the second support portion 51B.

The first support portion 51A supports the photosensitive drum 11Y, the charging device 12Y, and the developing device 13Y. The first support portion 51A includes a drum supporting side plate 511A, a drum supporting side plate 511B, and a shaft 512.

The drum supporting side plate 511A is positioned at one end portion of the process frame 51 in the second direction. The drum supporting side plate 511A extends in the third direction.

Figure 6:
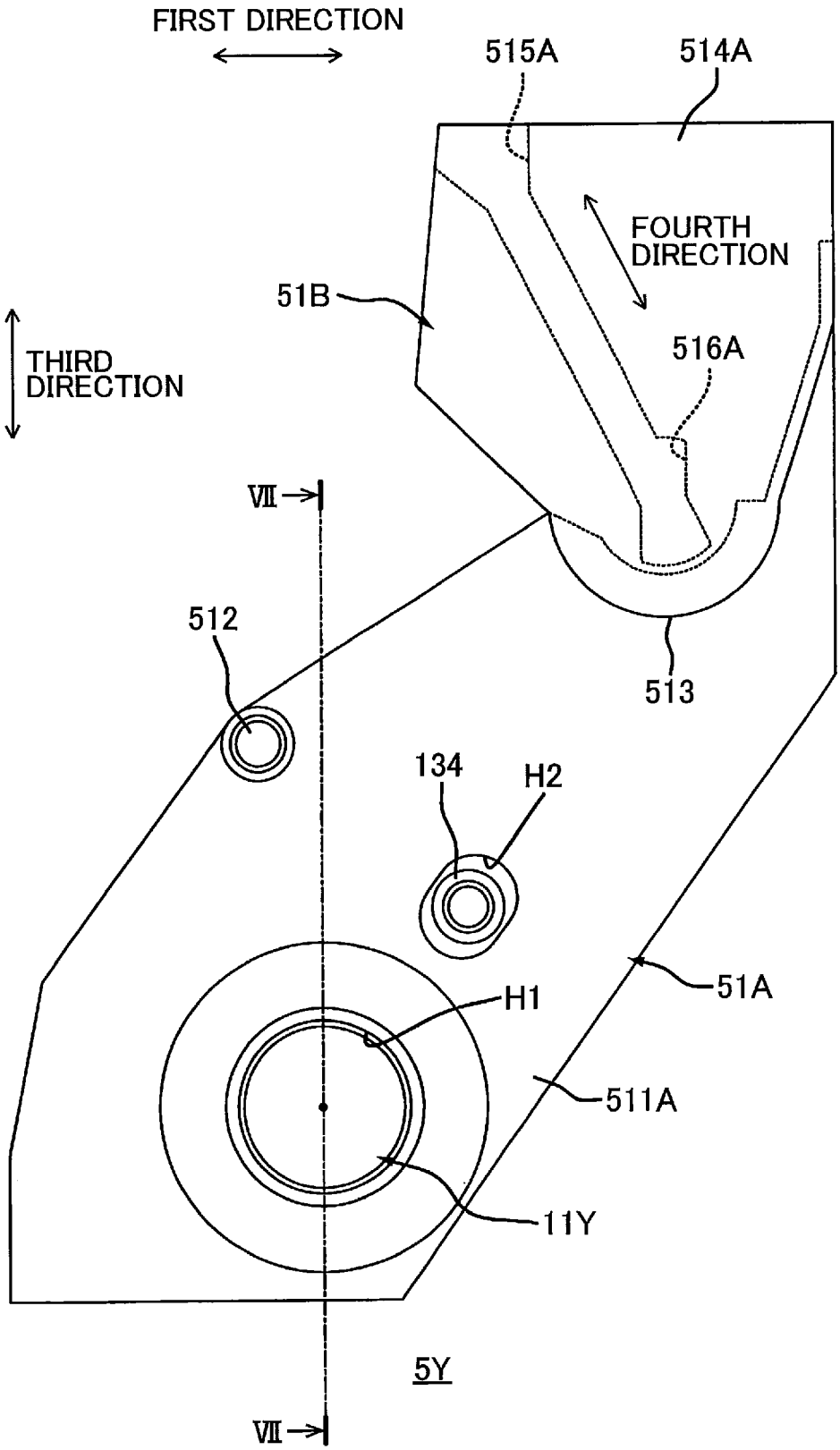
FIG. 6 is a side view of the process cartridge according to the embodiment shown in FIG. 5.

As illustrated in FIGS. 5 and 6, the drum supporting side plate 511A has a hole H1 and a hole H2.

The hole H1 is spaced apart from the second support portion 51B in the third direction. The hole 111 has a circular shape. One end portion in the second direction of the photosensitive drum 11Y is rotatably fitted in the hole H1. The drum supporting side plate 511A thus rotatably supports the one end portion of the photosensitive drum 11Y in the second direction.

The hole 112 is positioned between the hole H1 and the second support portion 51B in the third direction. The hole 112 has an elongated shape, and a protrusion 134 of the developing device 13Y is received in the hole 112. The protrusion 134 is positioned at one end portion of the developing casing 131Y in the second direction. The protrusion 134 has a columnar shape and extends in the second direction. Incidentally, the hole H2 may receive a shaft of the developing roller 132Y, instead of the protrusion 134. With the hole H2 receiving the protrusion 134, the drum supporting side plate 511A supports the one end portion of the developing device 13Y in the second direction. With the protrusion 134 fitted in the elongated hole H2, the protrusion 134 is movable relative to the drum supporting side plate 511A in an extending direction of the hole 112. In other words, with the protrusion 134 fitted in the hole 112, the developing device 13Y is movable relative to the drum supporting side plate 511A in the extending direction of the hole H2.

As illustrated in FIG. 5, the drum supporting side plate 511B is positioned at another end portion of the process frame 51 in the second direction. The drum supporting side plate 511B is spaced apart from the drum supporting side plate 511A in the second direction. The drum supporting side plate 511B supports another end portion of the photosensitive drum 11Y in the second direction. The drum supporting side plate 511B also supports another end portion of the developing device 13Y in the second direction. The drum supporting side plate 511B has a similar structure to the drum supporting side plate 511A.

The shaft 512 extends in the second direction. The shaft 512 has a columnar shape. The shaft 512 has one end portion in the second direction that is supported by the drum side plate 511A, and another end portion in the second direction that is supported by the drum side plate 511B. The developing device 13Y is connected to the shaft 512 so that the developing device 13Y is pivotable about an axis of the shaft 512.

The second support portion 51B is configured to support the toner cartridge 6Y in a state where the toner cartridge 6Y is attached to the process cartridge 5Y. The second support portion 51B is positioned above the first support portion 51A (toward the one side in the third direction than the first support portion 51A) in the state where the process cartridge 5Y is mounted on the drawer 4. That is, the second support portion 51B is positioned closer to the top wall of the main casing 2 than the first support portion 51A in the third direction in the state where the process cartridge 5Y is mounted on the drawer 4.

As illustrated in FIG. 4, in the state where the process cartridge 5Y is mounted on the drawer 4, the second support portion 51B is positioned higher (further toward the one side in the third direction) than each of the drawer side plates 41A and 41B in the third direction. Hence, in the state where the toner cartridge 6Y is attached to the process cartridge 5Y mounted on the drawer 4, the toner cartridge 6Y is positioned above each of the drawer side plates 41A and 41B in the third direction. That is, in the state where the toner cartridge 6Y is attached to the process cartridge 5Y mounted on the drawer 4, the toner cartridge 6Y is positioned closer to the top wall of the main casing 2 than each of the drawer side plates 41A and 41B is to the top wall of the main casing 2 in the third direction.

Figure 7:
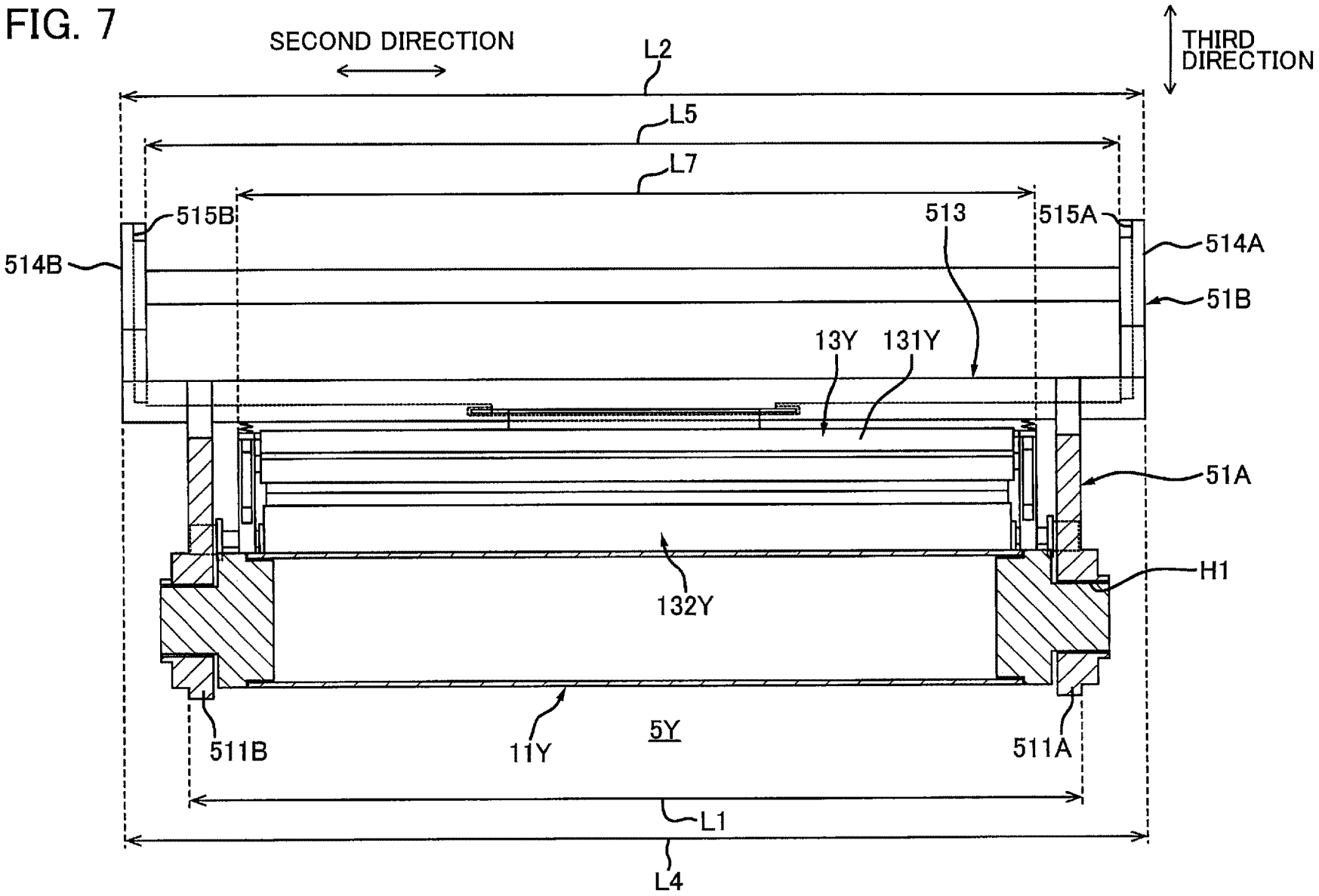
FIG. 7 is a cross-sectional view of the process cartridge according to the embodiment taken along a plane VII-VII in FIG. 6.

As illustrated in FIG. 7, the second support portion 51B extends in the second direction. The second support portion 51B has a length L2 in the second direction that is greater than a length L1 of the first support portion 51A in the second direction in the state where the process cartridge 5Y is mounted on the drawer 4. Further, the length L2 of the second support portion 51B in the second direction is greater than a distance L3 defined between the drawer side plate 41A and the drawer side plate 41B in the second direction (see FIG. 4) in the state where the process cartridge 5Y is mounted on the drawer 4.

As illustrated in FIG. 5, the second support portion 51B includes a receiving part 513, a toner supporting side plate 514A, and a toner supporting side plate 514B.

The receiving part 513 is configured to receive a second container 612 of the toner cartridge 6Y (see FIG. 10) when the toner cartridge 6Y is attached to the process cartridge 5Y. The second container 612 will be described later. The receiving part 513 extends in the second direction. The receiving part 513 has a semicylindrical shape that is recessed toward the developing device 13Y and photosensitive drum 11Y in the third direction. The receiving part 513 connects the drum supporting side plate 511A to the drum supporting side plate 511B.

As illustrated in FIG. 7, the receiving part 513 has a length L4 in the second direction that is greater than the length L1 of the first support portion 51A in the second direction in the state where the process cartridge 5Y is mounted on the drawer 4. Further, the length L4 of the receiving part 513 in the second direction is greater than the distance L3 between the drawer side plate 41A and the drawer side plate 41B in the second direction (see FIG. 4) in the state where the process cartridge 5Y is mounted on the drawer 4. Accordingly, the receiving part 513 can stably support the toner cartridge 6Y whose length in the second direction is greater than the distance L3 in the second direction between the drawer side plates 41A and 41B in the state the toner cartridge 6Y is attached to the process cartridge 5Y mounted on the drawer 4.

As illustrated in FIG. 5, the receiving part 513 has a toner receiving opening 513A and two holes 513B and 513C.

The toner receiving opening 513A is positioned in a center portion of the receiving part 513 in the second direction. The toner receiving opening 513A is in communication with the opening 133 of the developing casing 131Y (see FIG. 8). The toner receiving opening 513A is configured to receive the toner discharged through a toner discharge opening 614 of the toner cartridge 6Y (see FIG. 15) in the state where the toner cartridge 6Y is attached to the process cartridge 5Y. The toner discharge opening 614 will be described later.

The hole 513B is positioned between the toner receiving opening 513A and the drum side plate 511A in the second direction. The hole 513B is spaced apart from the toner receiving opening 513A in the second direction.

The hole 513C is positioned between the toner receiving opening 513A and the drum side plate 511B in the second direction. The hole 513C is positioned opposite the hole 513B with respect to the toner receiving opening 513A in the second direction. The hole 513C is spaced apart from the toner receiving opening 513A in the second direction.

The toner supporting side plate 514A is positioned at one end portion of the second support portion 51B in the second direction. The toner supporting side plate 514A is positioned opposite the drum supporting side plate 511B with respect to the drum supporting side plate 511A in the second direction (see FIG. 7). The toner supporting side plate 514A extends in the third direction. The toner supporting side plate 514A extends from one end portion of the receiving part 513 in the second direction.

As illustrated in FIG. 6, the toner supporting side plate 514A includes a toner guide 515A and a lock portion 516A.

The toner guide 515A extends in a fourth direction crossing the third direction. The fourth direction crosses the first direction and is orthogonal to the second direction. The toner guide 515A is a recessed groove. The toner guide 515A is configured to guide one end portion in the second direction of the second container 612 (see FIG. 10) for attachment of the toner cartridge 6Y to the process cartridge 5Y. Specifically, the toner guide 515A is configured to guide a protrusion 62A of the toner cartridge 6Y (see FIG. 10) for attachment of the toner cartridge 6Y to the process cartridge 5Y. The protrusion 62A will be described later.

The lock portion 516A is positioned midway at the toner guide 515A in the fourth direction. The lock portion 516A extends in the third direction. The lock portion 516A is a recessed groove. The lock portion 516A is continuous with the toner guide 515A.

As illustrated in FIG. 5, the toner supporting side plate 514B is spaced apart from the toner supporting side plate 514A in the second direction. The toner supporting side plate 514B is positioned at another end portion of the second support portion 51B in the second direction.

Referring to FIG. 7, the toner supporting side plate 514A and the toner supporting side plate 514B define a distance L5 therebetween in the second direction that is greater than the distance L3 in the second direction between the drawer side plate 41A and the drawer side plate 41B (see FIG. 4) in the state where the process cartridge 5Y is mounted on the drawer 4.

The toner supporting side plate 514B is positioned opposite the drum supporting side plate 511A with respect to the drum supporting side plate 511B in the second direction. The toner supporting side plate 514B extends in the third direction. The toner supporting side plate 514B extends from another end portion of the receiving part 513 in the second direction.

The toner supporting side plate 514A has a structure similar to that of the toner supporting side plate 514B.

Namely, the toner supporting side plate 514B includes a toner guide 515B and a lock portion 516B. The toner guide 515B is configured to guide another end portion in the second direction of the second container 612 (see FIG. 10) in the state where the toner cartridge 6Y is attached to the process cartridge 5Y. Specifically, the toner guide 515B is configured to guide a protrusion 62B of the toner cartridge 6Y (see FIG. 10) in the state where the toner cartridge 6Y is attached to the process cartridge 5Y. The protrusion 62B will be described later. The protrusion 62B is configured to be fitted in the lock portion 516B in the state where the toner cartridge 6Y is attached to the process cartridge 5Y. The toner cartridge 6Y is thus locked relative to the process cartridge 5Y when the protrusion 62B is received in the lock portion 516B.

Figure 9:
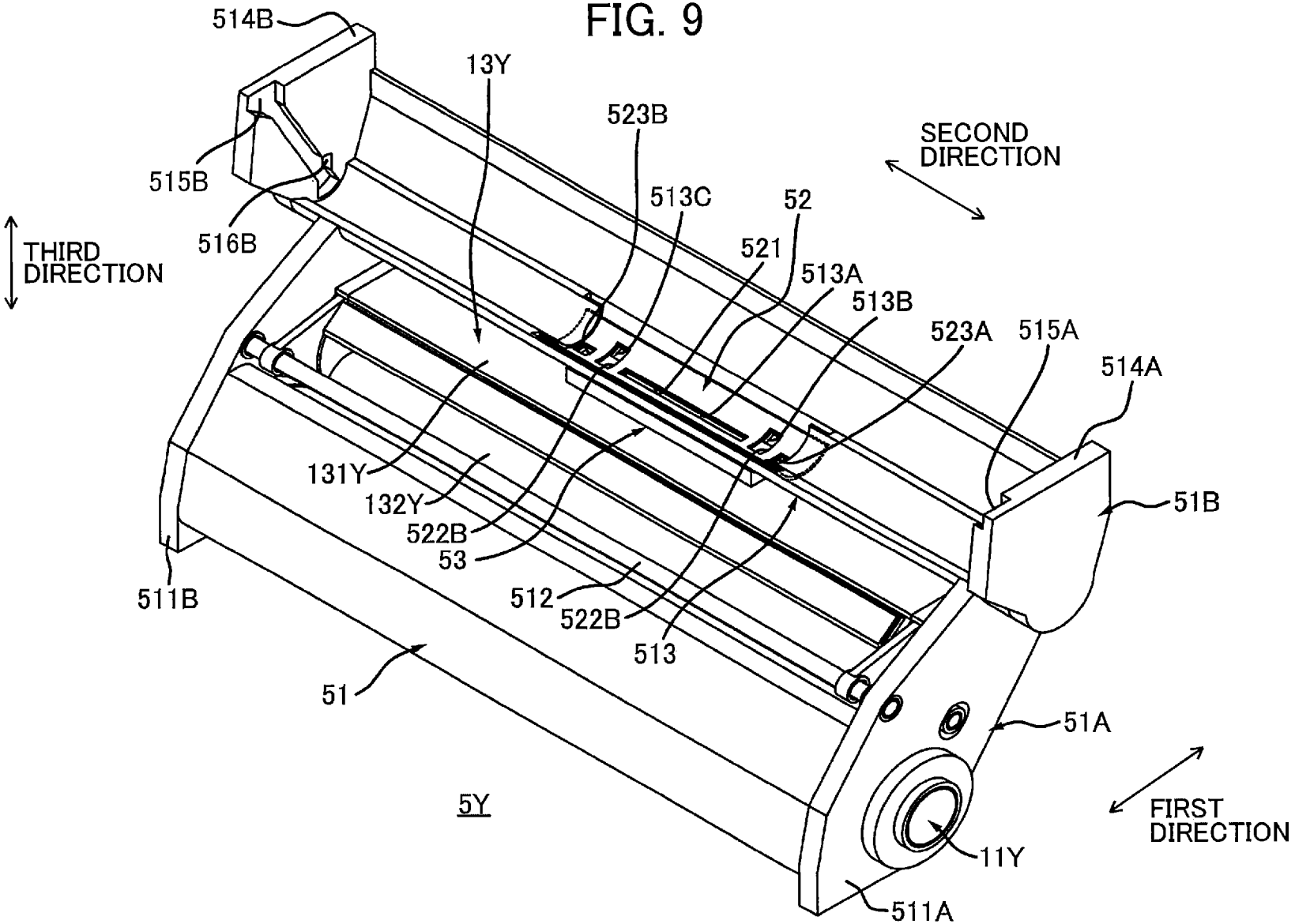
FIG. 9 is a perspective view of the process cartridge according to the embodiment, wherein the shutter of the process cartridge is at an open position.

As illustrated in FIG. 5, the shutter 52 is movably attached to the receiving part 513. The shutter 52 is configured to cover and uncover the toner receiving opening 513A. The shutter 52 is movable between a closed position (FIG. 5) and an open position (FIG. 9). The shutter 52 covers the toner receiving opening 513A when the shutter 52 is at the closed position. The toner receiving opening 513A is open when the shutter 52 is at the open position. The shutter 52 has a through-hole 521, two through-holes 522A and 522B, and two through-holes 523A and 523B.

The through-hole 521 extends in the second direction. As illustrated in FIG. 9, the through-hole 521 is at least partially in communication with the toner receiving opening 513A when the shutter 52 is at the open position. Thus, the toner receiving opening 513A is exposed when the shutter 52 is at the open position. On the other hand, as illustrated in FIG. 5, the through-hole 521 is offset from the toner receiving opening 513A when the shutter 52 is at the closed position.

The through-hole 522A is positioned between the through-hole 521 and the toner supporting side plate 514A in the second direction. The through-hole 522A is spaced apart from the through-hole 521 in the second direction. The through-hole 522A extends in a direction in which the shutter 52 is movable. The through-hole 522A is therefore in communication with the hole 513B, when the shutter 52 is at the closed position and at the open position.

The through-hole 522B is positioned between the through-hole 521 and the toner supporting side plate 514B in the second direction. The through-hole 522B is positioned opposite the through-hole 522A with respect to the through-hole 521 in the second direction. The through-hole 522B is spaced apart from the through-hole 521 in the second direction. The through-hole 522B extends in the direction in which the shutter 52 is movable. The through-hole 522B is thus in communication with the hole 513C, when the shutter 52 is at the closed position and at the open position.

The through-hole 523A is positioned between the through-hole 522A and the toner supporting side plate 514A in the second direction. The through-hole 523A is positioned opposite the through-hole 521 with respect to the through-hole 522A in the second direction.

The through-hole 523B is positioned between the through-hole 522B and the toner supporting side plate 514B in the second direction. The through-hole 523B is opposite the through-hole 521 with respect to the through-hole 522B in the second direction.

Figure 8:
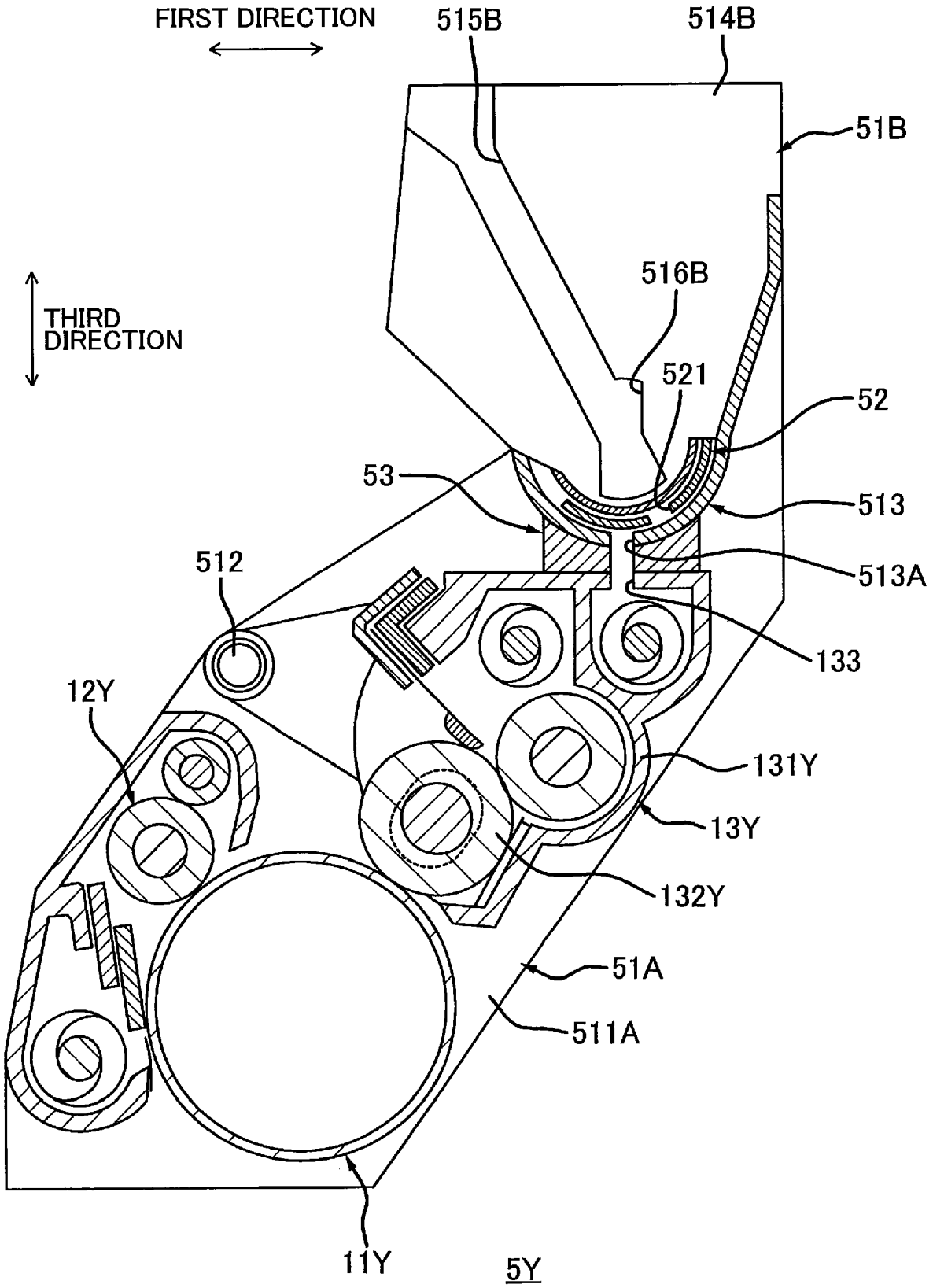
FIG. 8 is a cross-sectional view of the process cartridge according to the embodiment taken along a plane VIII-VIII in FIG. 5.

As illustrated in FIGS. 5 and 8, the sealing member 53 is provided between the receiving part 513 and the developing casing 131Y in the third direction. The sealing member 53 seals a gap between the receiving part 513 and the developing casing 131Y. The sealing member 53 surrounds the toner receiving opening 513A of the receiving part 513 and the opening 133 of the developing casing 131Y. The sealing member 53 is made of sponge, for example.

5. Details of the Toner Cartridge 6Y

Now, the toner cartridge 6Y will be described in detail with reference to FIGS. 10 to 16.

In the following description, the "first direction," "second direction," and "third direction" with respect to the toner cartridge 6Y will be referred to based on an assumption that the process cartridge 5Y is mounted on the drawer 4 and the toner cartridge 6Y is attached to the process cartridge 5Y. Hence, the "first direction," "second direction," and "third direction" with respect to the toner cartridge 6Y are coincident with the "first direction," "second direction," and "third direction" with respect to the image-forming apparatus 1 and drawer 4.

Figure 10:
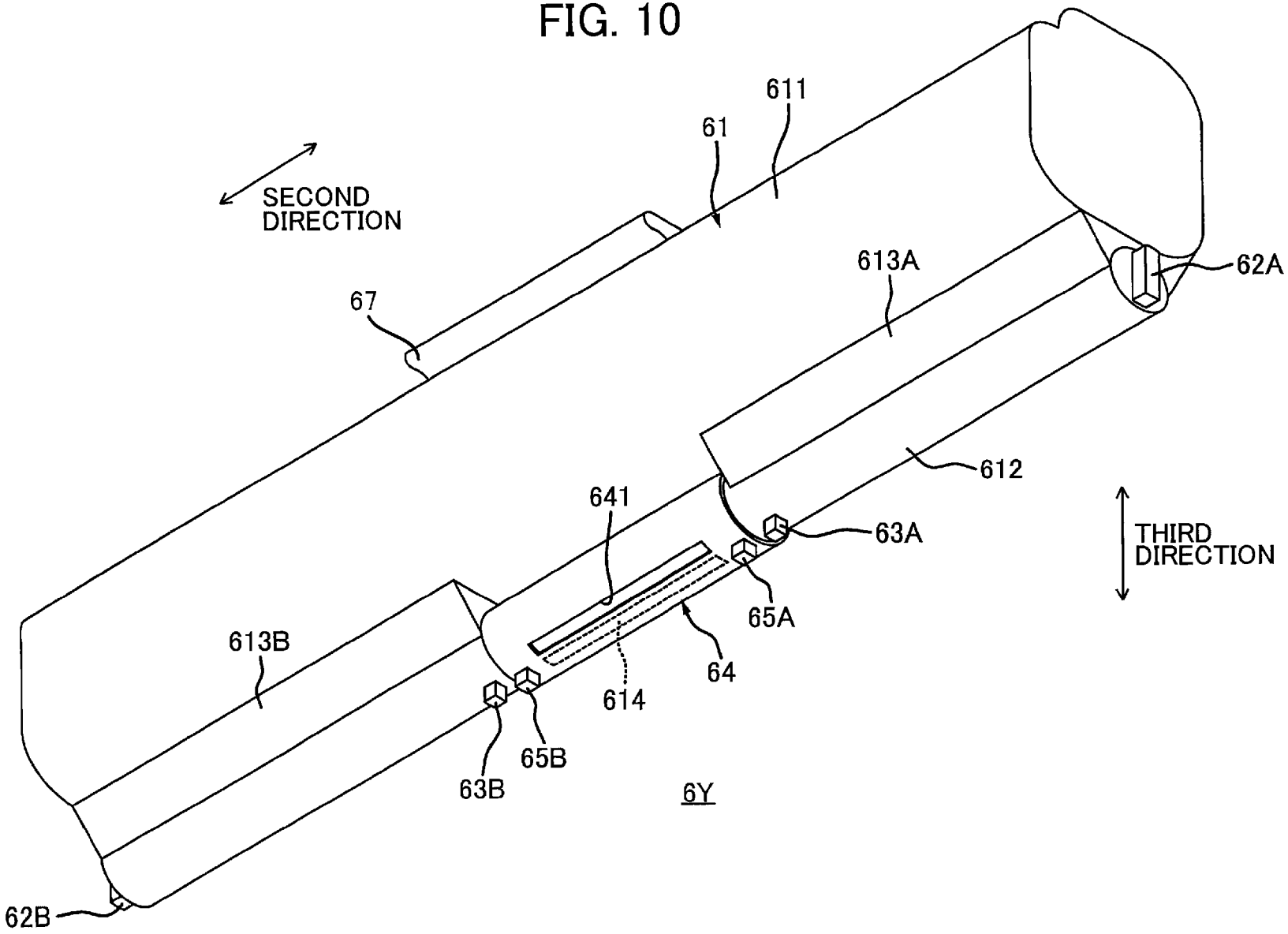
FIG. 10 is a perspective view of a toner cartridge according to the embodiment, wherein a shutter of the toner cartridge is at a closed position.
Figure 11:
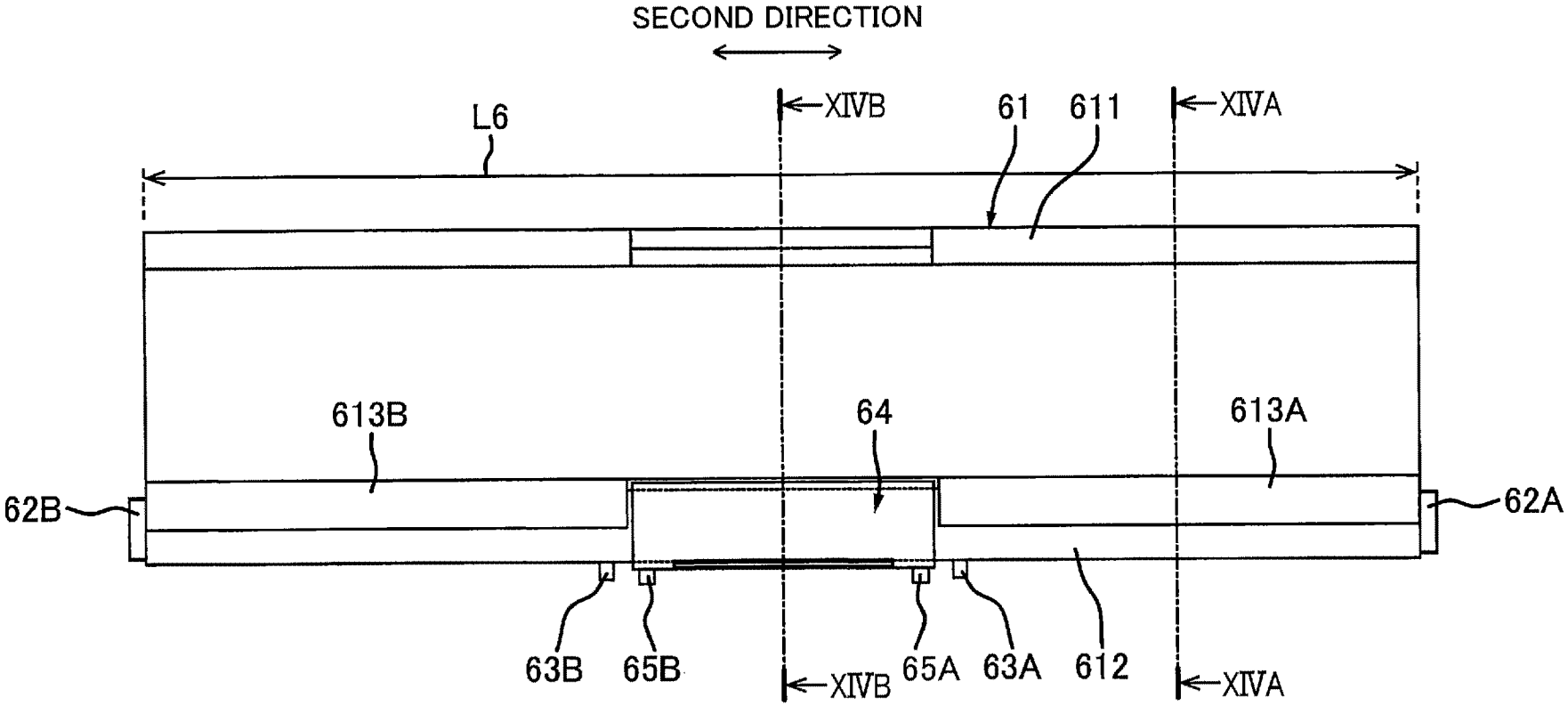
FIG. 11 is a plan view of the toner cartridge according to the embodiment.

As illustrated in FIGS. 10 and 11, the toner cartridge 6Y extends in the second direction. The toner cartridge 6Y includes a toner casing 61, the two protrusions 62A and 62B, two projections 63A and 63B, a shutter 64, two projections 65A and 65B, and a toner conveying member 66 (see FIG. 16).

The toner casing 61 extends in the second direction. The toner casing 61 has a length L6 in the second direction (FIG. 11) that is greater than the distance L3 between the drawer side plate 41A and the drawer side plate 41B in the second direction (see FIG. 4) in the state where the process cartridge 5Y is mounted on the drawer 4 and the toner cartridge 6Y is attached to the process cartridge 5Y. In other words, the length L6 of the toner cartridge 6Y in the second direction is greater than the distance L3 between the drawer side plate 41A and the drawer side plate 41B in the second direction in the state where the process cartridge 5Y is mounted on the drawer 4 and the toner cartridge 6Y is attached to the process cartridge 5Y.

With this configuration, the toner cartridge 6Y cannot be placed between the drawer side plate 41A and the drawer side plate 41B even if a user tries to attach the toner cartridge 6Y to the drawer 4 in a state where the process cartridge 5Y is removed from the drawer 4. That is, the user cannot mount the toner cartridge 6Y on the drawer 4 without attachment of the process cartridge 5Y to the drawer 4. In this way, this structure of the present embodiment can prevent user's mounting of the toner cartridge 6Y on the drawer 4 in the state where the process cartridge 5Y is removed from the drawer 4.

Incidentally, in the state where the process cartridge 5Y is mounted on the drawer 4 and the toner cartridge 6Y is attached to the process cartridge 5Y, the length L6 of the toner cartridge 6Y in the second direction may be no smaller than a distance L9 between the surface S1 of the drawer side plate 41A and the surface S3 of the drawer side plate 41B in the second direction (see FIG. 4).

Further, in the state where the process cartridge 5Y is mounted on the drawer 4 and the toner cartridge 6Y is attached to the process cartridge 5Y, the length L6 of the toner casing 61 in the second direction is greater than a length L7 of the developing casing 131Y in the second direction (see FIG. 7). To rephrase, the length L6 of the toner cartridge 6Y in the second direction is greater than the length L7 of the developing casing 131Y in the second direction in the state where the process cartridge 5Y is mounted on the drawer 4 and the toner cartridge 6Y is attached to the process cartridge 5Y.

Still further, in the state where the process cartridge 5Y is mounted on the drawer 4 and the toner cartridge 6Y is attached to the process cartridge 5Y, the length L6 of the toner casing 61 in the second direction is greater than a distance L8 in the second direction between the drawer guide 21A and the drawer guide 21B (see FIG. 4). To rephrase, the length L6 of the toner cartridge 6Y in the second direction is greater than the distance L8 between the drawer guide 21A and the drawer guide 21B in the second direction in the state where the process cartridge 5Y is mounted on the drawer 4 and the toner cartridge 6Y is attached to the process cartridge 5Y.

Figure 12:
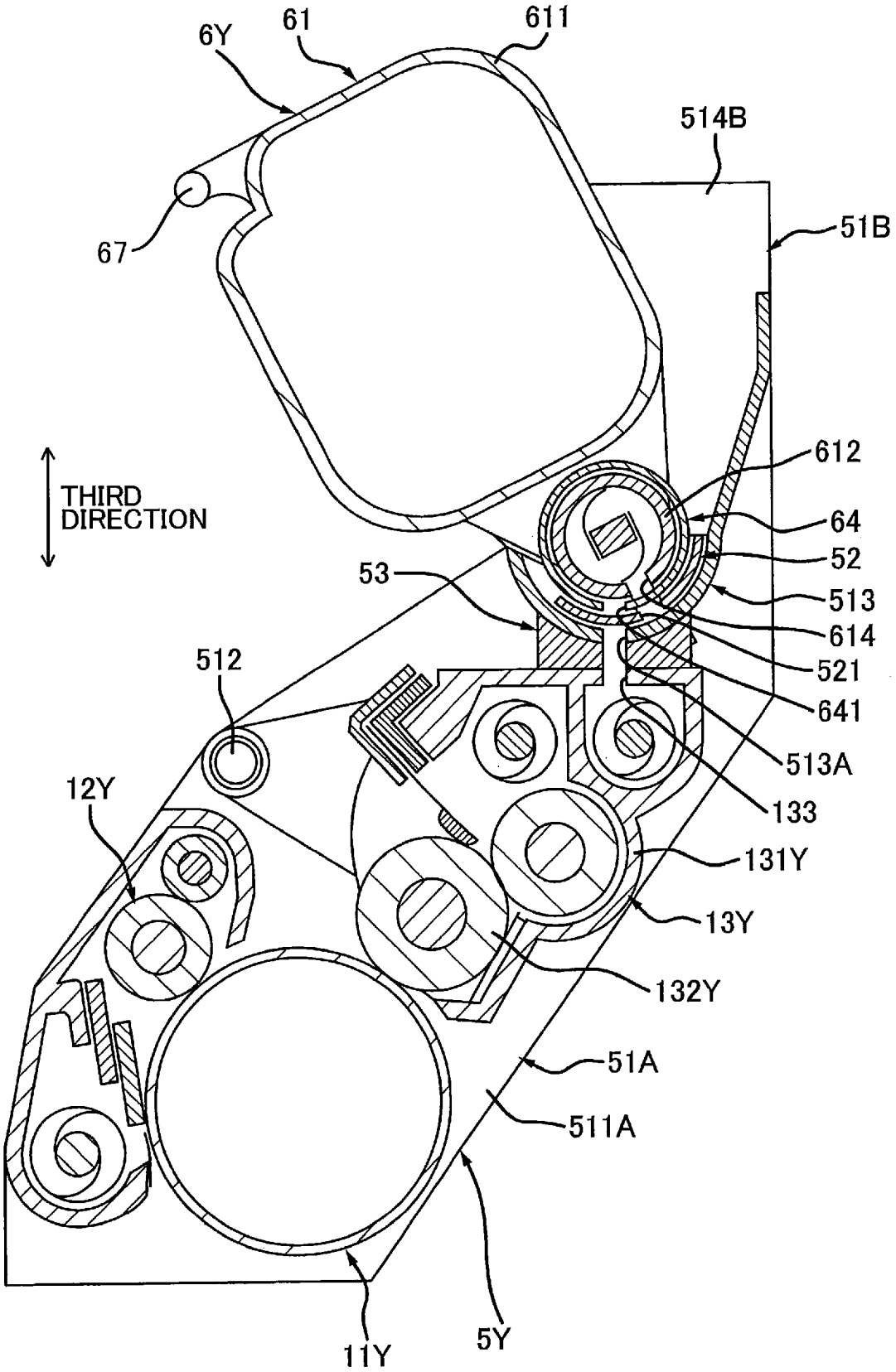
FIG. 12 is an explanatory view illustrating attachment of the toner cartridge to the process cartridge according to the embodiment, wherein the toner cartridge is at a first position.
Figure 13:
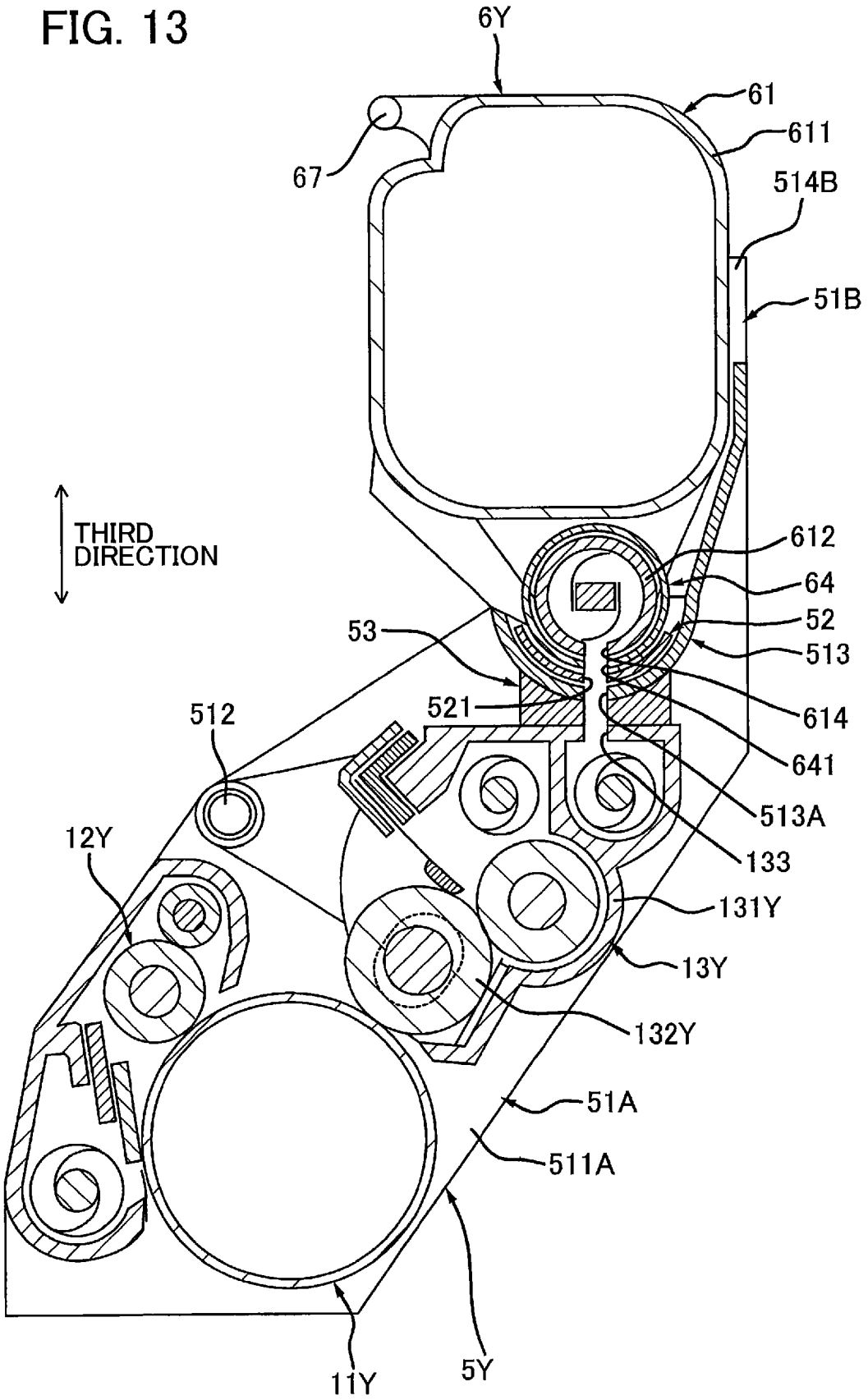
FIG. 13 is an explanatory view illustrating attachment of the toner cartridge to the process cartridge according to the embodiment, wherein the toner cartridge is at a second position.

As illustrated in FIGS. 12 and 13, the toner casing 61 is pivotable between a first position (see FIG. 12) and a second position (see FIG. 13) relative to the process cartridge 5Y in a state where the toner cartridge 6Y is supported by the second support portion 51B of the process cartridge 5Y. The toner cartridge 6Y can be removed from the process cartridge 5Y when the toner casing 61 is at the first position. The toner cartridge 6Y can be attached to the process cartridge 5Y while the toner casing 61 is at the second position. In the present embodiment, the state where "the toner cartridge 6Y is attached to the process cartridge 5Y" denotes a state where the toner cartridge 6Y is supported by the second support portion 51B and the toner casing 61 is at the second position.

As illustrated in FIGS. 10 and 11, the toner casing 61 includes a first container 611, the second container 612, and two connecting portions 613A and 613B. To rephrase, the toner cartridge 6Y includes the first container 611 and the second container 612.

The first container 611 extends in the second direction. The first container 611 has a generally cylindrical shape. Specifically, the first container 611 has a generally rectangular shape in cross section. The first container 611 can store toner therein. The first container 611 has a volume larger than a volume of the second container 612. A grip 67 is provided at one end portion of the first container 611 in the third direction.

As illustrated in FIG. 13, the second container 612 is positioned below the first container 611 in the state where the toner cartridge 6Y is attached to the process cartridge 5Y. The second container 612 is fitted with the receiving part 513 of the process cartridge 5Y in the state where the toner cartridge 6Y is attached to the process cartridge 5Y. In other words, the receiving part 513 receives the second container 612 in the state where the toner cartridge 6Y is supported by the second support portion 51B. In the state where the toner cartridge 6Y is attached to the process cartridge 5Y, the second container 612 is positioned between the first container 611 and the developing device 13Y in the third direction.

As illustrated in FIGS. 12 and 13, the toner casing 61 is pivotable about the second container 612 in the state where the toner cartridge 6Y is supported by the second support portion 51B of the process cartridge 5Y.

Figure 14B:
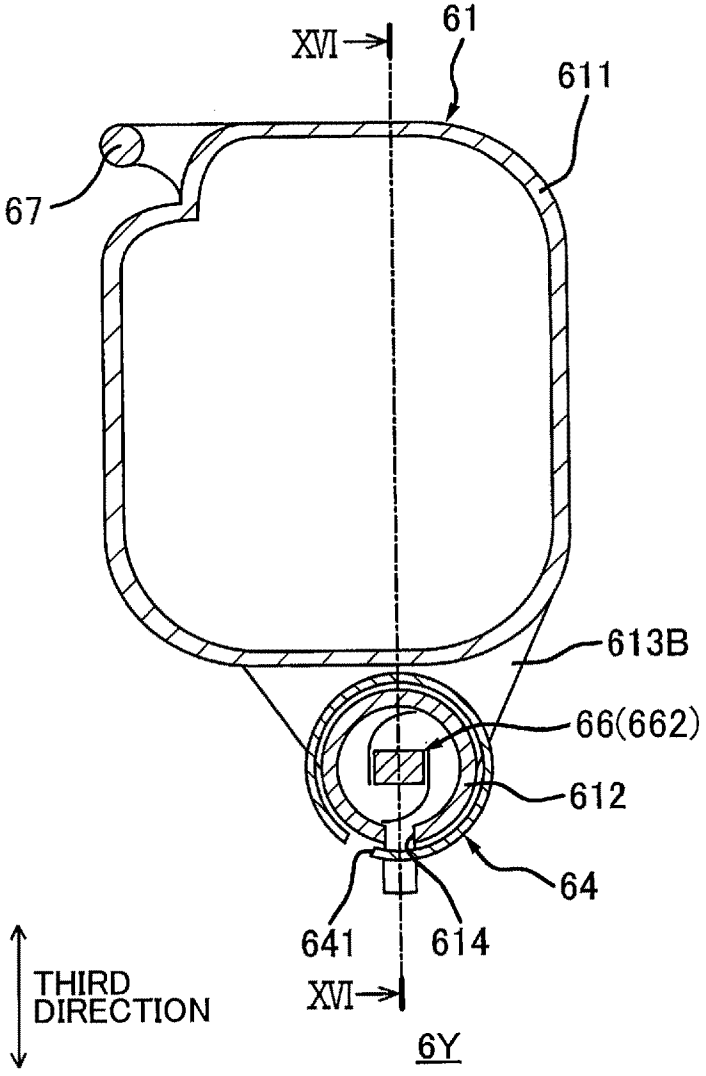
FIG. 14B is a cross-sectional view of the toner cartridge according to the embodiment taken along a plane XIVB—XIVB in FIG. 11.
Figure 14A:
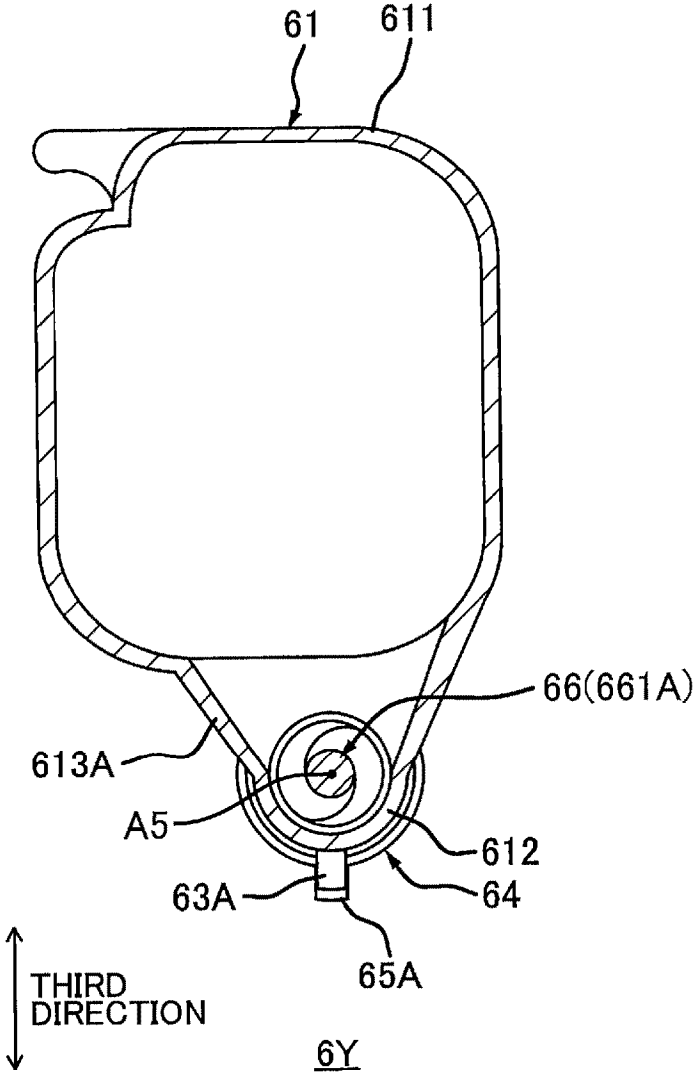
FIG. 14A is a cross-sectional view of the toner cartridge according to the embodiment taken along a plane XIVA-XIVA in FIG. 11.

As illustrated in FIGS. 10, 14A and 14B, the second container 612 is spaced apart from the first container 611. The second container 612 extends in the second direction. The second container 612 has a cylindrical shape. The second container 612 is positioned opposite the grip 67 with respect to the first container 611 in the third direction As illustrated in FIG. 10, the second container 612 has the toner discharge opening 614.

The toner discharge opening 614 is formed in a middle portion of the second container 612 in the second direction. The toner discharge opening 614 is positioned between the projection 63A and the projection 63B in the second direction. The toner discharge opening 614 is elongated in the second direction. The toner in the second container 612 can be discharged through the toner discharge opening 614.

The connecting portion 613A is provided between one end portion in the second direction of the first container 611 and one end portion in the second direction of the second container 612. The connecting portion 613A connects the one end portion in the second direction of the first container 611 to the one end portion in the second direction of the second container 612 to provide communication therebetween.

The connecting portion 613B is provided between another end portion in the second direction of the first container 611 and another end portion in the second direction of the second container 612. The connecting portion 613B is spaced apart from the connecting portion 613A in the second direction. The connecting portion 613B connects the other end portion in the second direction of the first container 611 and the other end portion in the second direction of the second container 612 to provide communication therebetween.

As illustrated in FIG. 14A, the second container 612 is in communication with the first container 611 via the connecting portion 613A. Likewise, the second container 612 is in communication with the first container 611 via the connecting portion 613B (see FIG. 10). The toner in the first container 611 flows into the second container 612 via the respective connecting portions 613A and 613B.

As illustrated in FIGS. 10 and 11, the protrusion 62A is positioned at the one end portion of the toner cartridge 6Y in the second direction. Specifically, the protrusion 62A is provided at the one end portion in the second direction of the second container 612. The protrusion 62A protrudes outward from the one end portion of the second container 612 in the second direction. The protrusion 62A protrudes in the second direction.

The protrusion 62B is positioned at the other end portion of the toner cartridge 6Y in the second direction. Specifically, the protrusion 62B is provided at the other end portion of the second container 612 in the second direction. The protrusion 62B protrudes outward from the other end portion of the second container 612 in the second direction. The protrusion 62B protrudes in the second direction.

The protrusion 62A is fitted in the toner guide 515A (FIG. 6) and the protrusion 62B is fitted in the toner guide 515B (FIG. 8) when the toner cartridge 6Y is attached to the process cartridge 5Y.

Further, the protrusion 62A is fitted in the lock portion 516A (FIG. 6) and the protrusion 62B is fitted in the lock portion 516B (FIG. 8) in the state where the toner cartridge 6Y is attached to the process cartridge 5Y. Due to the fitting of the protrusion 62A with the lock portion 516A and the fitting of the protrusion 62B with the lock portion 516B, the toner cartridge 6Y is locked (immovable) relative to the process cartridge 5Y.

The projection 63A is positioned between the toner discharge opening 614 and the protrusion 62A in the second direction. The projection 63A is positioned between the shutter 64 and the protrusion 62A in the second direction. The projection 63A is positioned opposite the first container 611 with respect to the second container 612 in the third direction. The projection 63A extends from a peripheral surface of the second container 612.

The projection 63B is spaced apart from the projection 63A in the second direction. The projection 63B is positioned opposite the projection 63A with respect to the toner discharge opening 614 in the second direction. The projection 63B is positioned between the toner discharge opening 614 and the protrusion 62B in the second direction. The projection 63B is positioned opposite the projection 63A with respect to the shutter 64 in the second direction. The projection 63B is positioned between the shutter 64 and the protrusion 62B in the second direction. The projection 63B is positioned opposite the first container 611 with respect to the second container 612 in the third direction. The projection 63B extends from the peripheral surface of the second container 612.

In the state where the toner cartridge 6Y is attached to the process cartridge 5Y, the projection 63A is fitted in the through-hole 523A of the shutter 52 and the projection 63B is fitted in the through-hole 523B of the shutter 52 (see FIG. 5).

With the projection 63A fitted in the through-hole 523A and the projection 63B fitted in the through-hole 523B of the shutter 52, the shutter 52 is made movable together with the toner casing 61. The shutter 52 of the process cartridge 5Y is thus allowed to move from the closed position to the open position in conjunction with the movement of the toner casing 61 from the first position to the second position; and from the open position to the closed position in conjunction with the movement of the toner casing 61 from the second position to the first position.

The shutter 64 is positioned between the connecting portion 613A and the connecting portion 613B in the second direction. The shutter 64 is provided over the peripheral surface of the second container 612.

Figure 15:
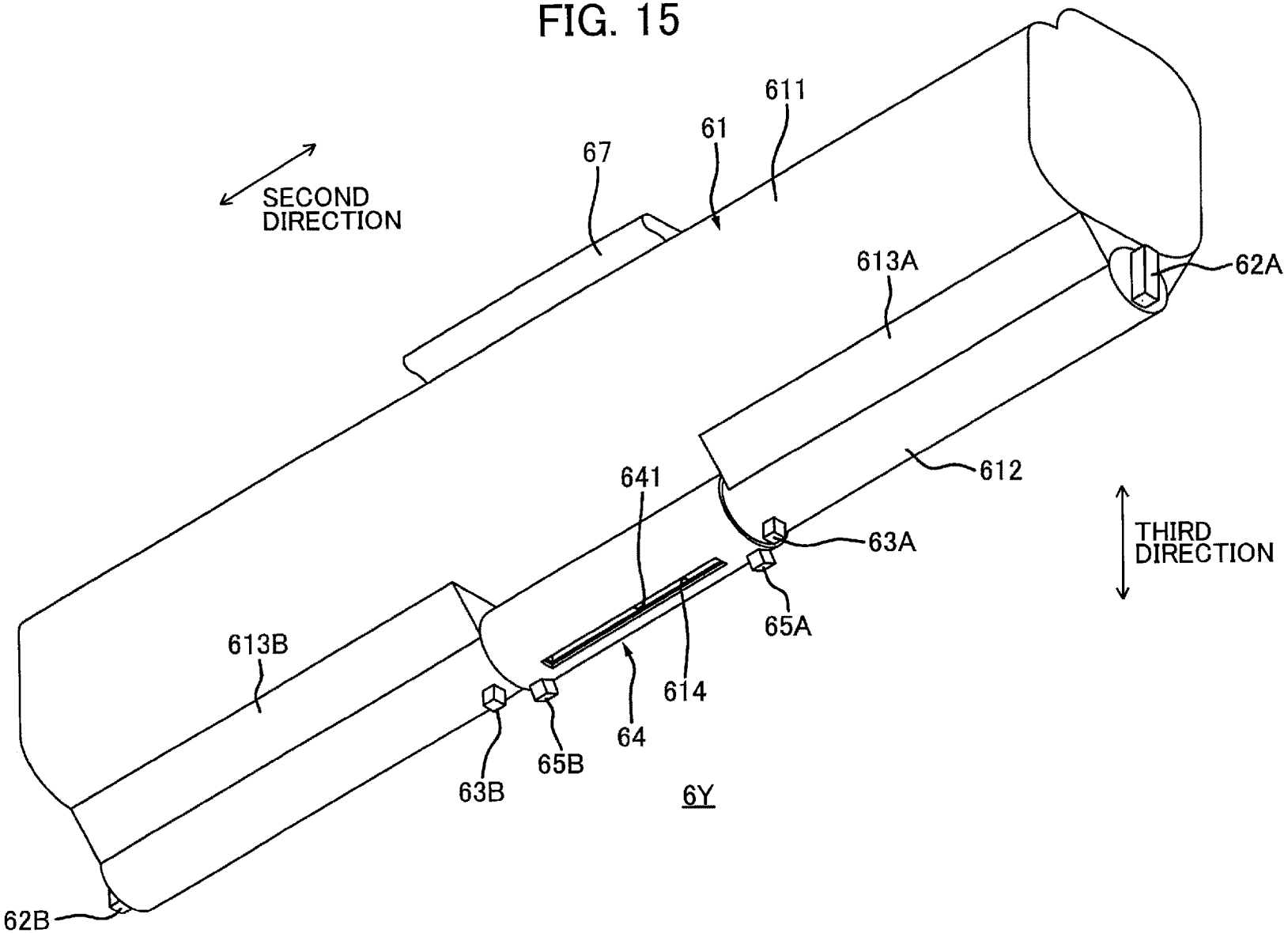
FIG. 15 is a perspective view of the toner cartridge according to the embodiment, wherein the shutter of the toner cartridge is at an open position.

The shutter 64 is movable between a closed position (illustrated in FIG. 10) and an open position (illustrated in FIG. 15) relative to the toner discharge opening 614. As illustrated in FIG. 10, the shutter 64 covers the toner discharge opening 614 when the shutter 64 is at the closed position. As illustrated in FIG. 15, the toner discharge opening 614 is exposed (opened) when the shutter 64 is at the open position.

The shutter 64 extends in the second direction. The shutter 64 has a cylindrical shape in conformance with the peripheral surface of the second container 612. The shutter 64 has an opening 641.

The opening 641 is elongated in the second direction. The opening 641 is at least partially in communication with the toner discharge opening 614 when the shutter 64 is at the open position. The opening 641 is displaced from the toner discharge opening 614 when the shutter 64 is at the closed position.

The projection 65A is provided on a peripheral surface of the shutter 64. The projection 65A protrudes from the peripheral surface of the shutter 64. The projection 65A is positioned between the opening 641 and the projection 63A in the second direction.

The projection 65B is spaced apart from the projection 65A in the second direction. The projection 65B is positioned opposite the projection 65A with respect to the opening 641 in the second direction. The projection 65B is provided on the peripheral surface of the shutter 64. The projection 65B protrudes from the peripheral surface of the shutter 64. The projection 65B is positioned between the opening 641 and the projection 63B in the second direction.

In the state where the toner cartridge 6Y is attached to the process cartridge 5Y, the projection 65A penetrates through the through-hole 522A of the shutter 52 and is fitted in the hole 513B of the receiving part 513; and the projection 65B penetrates through the through-hole 522B of the shutter 52 and is fitted in the hole 513C of the receiving part 513 (see FIG. 5).

With the projection 65A fitted in the hole 513B of the receiving part 513 and the projection 65B fitted in the hole 513C of the receiving part 513, the shutter 64 is fixed (immovable) relative to the receiving part 513 in the state where the toner cartridge 6Y is attached to the process cartridge 5Y.

In this way, the toner casing 61 is therefore movable relative to the shutter 64 fixed to the receiving part 513, as the toner casing 61 moves between the first position and the second position.

Specifically, the shutter 64 moves to the open position, relative to the toner casing 61, in accordance with the movement of the toner easing 61 from the first position to the second position. Further, the shutter 64 moves to the closed position, relative to the toner casing 61, in accordance with the movement of the toner casing 61 from the second position to the first position.

Here, for a comparative purpose, assume a typical toner cartridge in which a toner discharge opening and a shutter are positioned at a downstream end portion of the toner cartridge in an attaching direction thereof to a process cartridge. In this type of toner cartridge, a lever for opening the shutter is provided to extend from the shutter toward an upstream end portion of the toner cartridge in the attaching direction.

In this toner cartridge, the lever may be operated accidentally to open the shutter before the toner cartridge is attached to the process cartridge, which may result in toner leakage. Also, any damage to the lever may be conceivable in this toner cartridge. In particular, if a sealing member is provided between the shutter and a toner casing in this toner cartridge in order to prevent toner leakage, the lever needs to move the shutter against pressure from the sealing member. Accordingly, the lever may be damaged unless the lever has sufficiently high rigidity.

In this respect, in the present embodiment, the shutter 64 is movable between the open position and the closed position in accordance with the pivoting of the toner casing 61, with the shutter 64 fixed to the receiving part 513 of the process cartridge 5Y, as illustrated in FIGS. 12 and 13.

Hence, the user only needs to perform attachment of the toner cartridge 6Y to the process cartridge 5Y for opening the shutter 64, without performing any other operation to open the shutter 64. In other words, the user cannot perform the operation to open the shutter 64 alone, independently of the operation to attach the toner cartridge 6Y to the process cartridge 5Y. With this configuration, accidental opening of the shutter 64 can be prevented, and, hence, accidental toner leakage from the toner cartridge 6Y is unlikely to occur.

Further, since no lever is required for opening the shutter 64, accidental damage to the lever would not happen.

Still further, the user can hold an upstream end portion of the toner casing 61 in the attaching direction of the toner cartridge 6Y (i.e., the grip 67) to pivot the toner casing 61 as a whole about the second container 612 (downstream end portion of the toner casing 61 in the attaching direction). Accordingly, the user can open the shutter 64 with smaller force, by utilizing the principle of leverage. In particular, even in a case where a sealing member is provided between the shutter 64 and the toner casing 61 to prevent toner leakage from the toner cartridge 6Y storing toner of high fluidity, the user can still open the shutter 64 easily.

Figure 16:
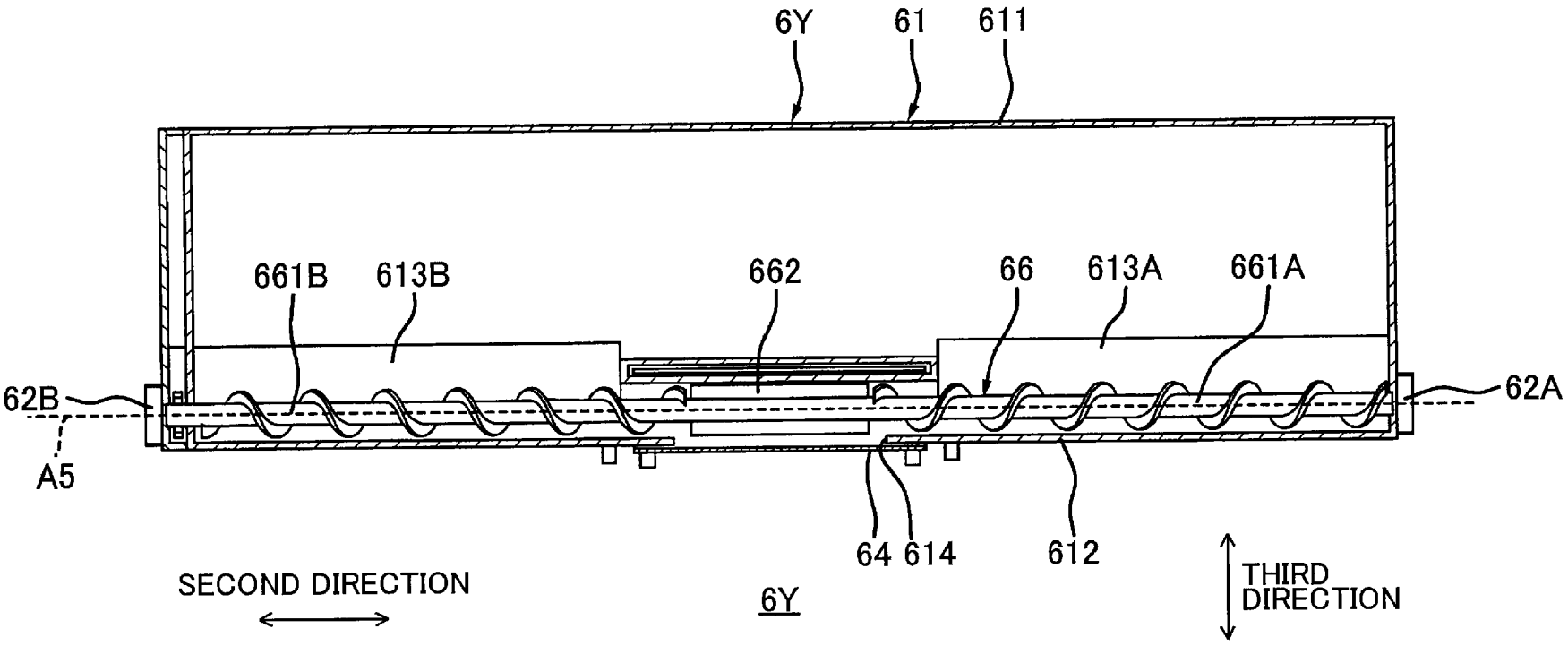
FIG. 16 is a cross-sectional view of the toner cartridge according to the embodiment taken along a plane XVI-XVI in FIG. 14B.

As illustrated in FIG. 16, the toner conveying member 66 is provided inside the second container 612. The toner conveying member 66 is rotatable about an axis A5 extending in the second direction. The toner conveying member 66 extends along the axis A5. The toner conveying member 66 includes two screw portions 661A and 661B, and a propeller portion 662.

The screw portion 661A is positioned at one end portion of the toner conveying member 66 in the second direction. The screw portion 661A extends in the second direction. The screw 661A is configured to convey, toward the toner discharge opening 614, the toner that has entered the second container 612 via the connecting portion 613A.

The screw portion 661B is positioned at another end portion of the toner conveying member 66 in the second direction. The screw portion 661B is spaced apart from the screw portion 661A in the second direction. The screw portion 661B extends in the second direction. The screw 661B is configured to convey, toward the toner discharge opening 614, the toner that has entered the second container 612 via the connecting portion 613B.

The propeller portion 662 is positioned between the screw portion 661A and the screw portion 661B in the second direction.

6. Operational and Technical Advantages (1) In the image-forming apparatus 1 according to the present embodiment, as illustrated in FIG. 4, the length L6 of the toner cartridge 6Y in the second direction (FIG. 11) is greater than the distance L3 between the drawer side plate 41A and the drawer side plate 41B in the second direction (FIG. 4) in the state where the process cartridge 5Y is mounted on the drawer 4 and the toner cartridge 6Y is attached to the process cartridge 5Y.

With this structure, fitting of the toner cartridge 6Y into a space between the drawer side plate 41A and the drawer side plate 41B is not allowed, even if a user tries to mount the toner cartridge 6Y on the drawer 4 in the state where the process cartridge 5Y is removed from the drawer 4.

That is, the user cannot mount the toner cartridge 6Y on the drawer 4 without the process cartridge 5Y mounted on the drawer 4. In this way, user's attachment of the toner cartridge 6Y to the drawer 4 can be reliably prevented in the state where the process cartridge 5Y is removed from the drawer 4.

(2) According to the image-forming apparatus 1, the length L4 in the second direction of the receiving part 513 of the process cartridge 5Y (FIG. 7) is greater than the distance L3 between the drawer side plate 41A and the drawer side plate 41B in the second direction (FIG. 4) in the state where the process cartridge 5Y is mounted on the drawer 4.

With this structure, the receiving part 513 can stably support the toner cartridge 6Y having the length L6 in the second direction that is greater than the distance L3 between the drawer side plate 41A and the drawer side plate 41B in the state where the toner cartridge 6Y is attached to the process cartridge 5Y mounted on the drawer 4.

(3) In the image-forming apparatus 1 according to the present embodiment, the sealing member 53 is provided between the receiving part 513 and the developing casing 131Y to enclose the toner receiving opening 513A and opening 133 as illustrated in FIGS. 5 and 8.

With this structure, the toner flowing from the toner receiving opening 513A toward the opening 133 can be prevented from leaking out of the region between the receiving part 513 and the developing casing 131Y.

While the description has been made in detail with reference to the embodiments, it would be apparent to those skilled in the art that many modifications and variations may be made thereto.

[Remarks]

The image-forming apparatus 1 is an example of an image-forming apparatus. The main casing 2 is an example of a main casing. The drawer 4 is an example of a drawer. The process cartridge 5Y is an example of a process cartridge. The toner cartridge 6Y is an example of a toner cartridge. The photosensitive drum 11Y is an example of a photosensitive drum. The developing device 13Y is an example of a developing device. The drawer side plates 41A and 41B are examples of a first drawer side plate and a second drawer side plate, respectively. The surfaces S1 and S2 of the drawer side plate 41A are examples of a first surface and a second surface. The surfaces S3 and S4 of the drawer side plate 41B are examples of a third surface and a fourth surface. The first support portion 51A and second support portion 51B are examples of a first support portion and a second support portion. The first container 611 is an example of a first container. The second container 612 is an example of a second container. The toner discharge opening 614 is an example of a toner receiving opening. The receiving part 513 is an example of a receiving part. The toner receiving opening 513A is an example of a toner receiving opening. The toner supporting side plate 514A and toner supporting side plate 514B are examples of a first toner supporting side plate and a second toner supporting side plate. The toner guide 515A of the toner supporting side plate 514A is an example of a first toner guide. The toner guide 515B of the toner supporting side plate 514B is an example of a second toner guide. The developing casing 131Y is an example of a developing casing. The developing roller 132Y is an example of a developing roller. The sealing member 53 is an example of a sealing member. The drum guide 411Y of the drawer side plate 41A is an example of a first drum guide. The drum guide 112Y of the drawer side plate 41B is an example of a second drum guide. The drawer guides 21A and 21B are examples of a first drawer guide and a second drawer guide, respectively. The intermediate transfer belt 81 is an example of an intermediate transfer belt. The transfer roller 9 is an example of a transfer roller.

What is claimed is:

1. An image-forming apparatus comprising:

a main casing;

a drawer movable in a first direction between an inner position and an outer position relative to the main casing, the drawer being accommodated in the main casing at the inner position, and at least a part of the drawer being positioned outside the main casing at the outer position, the drawer comprising a first drawer side plate and a second drawer side plate spaced apart from each other in a second direction crossing the first direction;

a process cartridge detachably mountable on the drawer, the process cartridge comprising:

a photosensitive drum rotatable about a drum axis, the drum axis extending in the second direction when the process cartridge is mounted on the drawer; and a developing device configured to supply toner to the photosensitive drum; and a toner cartridge configured to store the toner, wherein, when the process cartridge is mounted on the drawer and the toner cartridge is attached to the process cartridge, the toner cartridge has a length in the second direction that is greater than a distance in the second direction between the first drawer side plate and the second drawer side plate.

2. The image-forming apparatus according to claim 1, wherein the first drawer side plate has a first surface and a second surface opposite each other in the second direction, the second surface being positioned closer to the second drawer side plate than the first surface is to the second drawer side plate in the second direction, wherein the second drawer side plate has a third surface and a fourth surface opposite each other in the second direction, the fourth surface being positioned closer to the first drawer side plate than the third surface is to the first drawer side plate in the second direction, and wherein, when the process cartridge is mounted on the drawer and the toner cartridge is attached to the process cartridge, the length of the toner cartridge in the second direction is greater than a distance in the second direction between the first surface and the third surface.

3. The image-forming apparatus according to claim 1, wherein the drawer is open in a third direction crossing the first direction and the second direction, and wherein, when the process cartridge is mounted on the drawer and the toner cartridge is attached to the process cartridge, the toner cartridge is positioned closer to a top wall of the main casing than the first drawer side plate and the second drawer side plate are to the top wall of the main casing in the third direction.

4. The image-forming apparatus according to claim 1, wherein the process cartridge comprises:

a first support portion supporting the photosensitive drum and the developing device; and a second support portion configured to support the toner cartridge when the toner cartridge is attached to the process cartridge, wherein, when the process cartridge is mounted on the drawer, the second support portion has a length in the second direction that is greater than a length in the second direction of the first support portion.

5. The image-forming apparatus according to claim 4, wherein the length in the second direction of the second support portion is greater than the distance in the second direction between the first drawer side plate and the second drawer side plate.

6. The image-forming apparatus according to claim 4, wherein the toner cartridge comprises:

a first container configured to store the toner;

a second container in communication with the first container, the second container having a toner discharge opening for discharging the toner, wherein the second support portion comprises a receiving part configured to receive the second container when the toner cartridge is attached to the process cartridge, the receiving part having a toner receiving opening configured to communicate with the toner discharge opening when the toner cartridge is attached to the process cartridge.

7. The image-forming apparatus according to claim 6, wherein, when the process cartridge is mounted on the drawer, the receiving part has a length in the second direction that is greater than the distance in the second direction between the first drawer side plate and the second drawer side plate.

8. The image-forming apparatus according to claim 6, wherein the second support portion further comprises:

a first toner supporting side plate extending from the receiving part; and a second toner supporting side plate extending from the receiving part and spaced apart from the first toner supporting side plate in the second direction, wherein, when the process cartridge is mounted on the drawer and the toner cartridge is attached to the process cartridge, the first toner supporting side plate and the second toner supporting side plate define a distance therebetween in the second direction that is greater than the distance in the second direction between the first drawer side plate and the second drawer side plate.

9. The image-forming apparatus according to claim 8, wherein the first toner supporting side plate comprises a first toner guide, and the second toner supporting side plate comprises a second toner guide, and wherein the second container has one end portion and another end portion in the second direction, the first toner guide being configured to guide the one end portion in the second direction of the second container and the second toner guide being configured to guide the another end portion in the second direction of the second container for attachment of the toner cartridge to the process cartridge.

10. The image-forming apparatus according to claim 6, wherein the developing device comprises:

a developing casing having an opening in communication with the toner receiving opening and configured to store the toner supplied from the toner cartridge; and a developing roller configured to supply the toner stored in the developing casing to the photosensitive drum, wherein the process cartridge further comprises a sealing member positioned between the receiving part and the developing casing to provide sealing therebetween, the sealing member enclosing the toner receiving opening and the opening of the developing casing.

11. The image-forming apparatus according to claim 1, wherein the first drawer side plate comprises a first drum guide, and the second drawer side plate comprises a second drum guide, wherein the photosensitive drum has one end portion and another end portion in the second direction, the first drum guide being configured to guide the one end portion in the second direction of the photosensitive drum and the second drum guide being configured to guide the another end portion in the second direction of the photosensitive drum for mounting of the process cartridge on the drawer.

12. The image-forming apparatus according to claim 1, wherein the developing device comprises:

a developing casing configured to store the toner supplied from the toner cartridge; and a developing roller configured to supply the toner stored in the developing casing to the photosensitive drum, and wherein, when the process cartridge is mounted on the drawer and the toner cartridge is attached to the process cartridge, the length of the toner cartridge in the second direction is greater than a length in the second direction of the developing casing.

13. The image-forming apparatus according to claim 1, wherein the main casing comprises:

a first drawer guide configured to guide the first drawer side plate during movement of the drawer between the inner position and the outer position; and a second drawer guide configured to guide the second drawer side plate during movement of the drawer between the inner position and the outer position, and wherein, when the process cartridge is mounted on the drawer and the toner cartridge is attached to the process cartridge, the length of the toner cartridge in the second direction is greater than a distance in the second direction between the first drawer guide and the second drawer guide.

14. The image-forming apparatus according to claim 1, further comprising:

a second process cartridge detachably mountable on the drawer, the second process cartridge comprising:

a second photosensitive drum rotatable about a second drum axis, the second drum axis extending in the second direction when the second process cartridge is mounted on the drawer; and a developing device configured to supply second toner to the photosensitive drum; and a second toner cartridge configured to store the second toner.

15. The image-forming apparatus according to claim 1, further comprising:

an intermediate transfer belt configured to make contact with the photosensitive drum when the process cartridge is mounted on the drawer and the drawer is at the inner position; and a transfer roller configured to transfer toner on the intermediate transfer belt to a sheet.

* * * * *